US007861950B2

(12) United States Patent
Rossner et al.

(10) Patent No.: US 7,861,950 B2
(45) Date of Patent: Jan. 4, 2011

(54) TEXTURE SPRAYER NOISE REDUCER

(75) Inventors: Ross Rossner, St. Michael, MN (US); Matt Bischel, Maple Grove, MN (US); Craig Peterson, Carver, MN (US); Anthony J. Torntore, Sr., Bloomington, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 536 days.

(21) Appl. No.: 11/469,723

(22) Filed: Sep. 1, 2006

(65) Prior Publication Data

US 2007/0261913 A1 Nov. 15, 2007

Related U.S. Application Data

(63) Continuation-in-part of application No. 11/411,644, filed on Apr. 26, 2006, now Pat. No. 7,731,104.

(51) Int. Cl.
*B05B 7/30* (2006.01)

(52) U.S. Cl. ..... 239/345; 239/355; 239/502; 239/504; 239/522; 239/590; 239/601

(58) Field of Classification Search ..... 239/589, 239/590, 590.5, 591, 601, 345, 355
See application file for complete search history.

(56) References Cited

U.S. PATENT DOCUMENTS 1,792,803 A 2/1931 Brandt
1,881,570 A * 10/1932 Hermann ..... 239/290
2,707,068 A 4/1955 Williamson
3,236,459 A 2/1966 McRitchie
3,275,248 A * 9/1966 O'Brien et al. ..... 239/487
3,486,700 A * 12/1969 Bristow ..... 239/590.5
3,945,571 A 3/1976 Rash
4,079,868 A * 3/1978 Moniot ..... 222/591
4,411,387 A * 10/1983 Stern et al. ..... 239/345

(Continued)

FOREIGN PATENT DOCUMENTS

DE 3416169 11/1985

(Continued)

OTHER PUBLICATIONS

Product Information, "Compressor Care on the Web-Paint Spraying Sandblast Blowguns," http://www.compressor-care.com, 2 pp.

(Continued)

*Primary Examiner*—Dinh Q Nguyen
(74) *Attorney, Agent, or Firm*—Faegre & Benson LLP

(57) ABSTRACT

A hand-held apparatus for spraying texture material including a body, a pressurized air source mounted on the body, a texture material hopper mounted on the body, and a texture delivery nozzle for selectively spraying texture material from the hopper onto a surface to be coated by propelling the texture material using pressurized air from the pressurized air source wherein each of the air source and the hopper can be disconnected from the body without the use of tools. An air directing plunger has a plurality of discontinuities at an outlet thereof, which may be radially outwardly directed recesses or radially inwardly directed teeth for reducing the noise generated by the pressurized air during operation.

13 Claims, 33 Drawing Sheets

U.S. PATENT DOCUMENTS

| | | | | |
|---|---|---|---|---|
| 4,545,534 | A | 10/1985 | Schaefer | |
| 4,863,104 | A | 9/1989 | Masterson | |
| 4,961,537 | A | 10/1990 | Stern | |
| 4,978,072 | A | 12/1990 | Kurowski | |
| 5,037,011 | A | 8/1991 | Woods | |
| 5,119,993 | A | 6/1992 | Gunzel, Jr. et al. | |
| 5,139,357 | A | 8/1992 | Reents | |
| 5,188,263 | A | 2/1993 | Woods | |
| 5,190,225 | A | 3/1993 | Williams | |
| 5,232,161 | A | 8/1993 | Clemmons | |
| 5,255,846 | A | 10/1993 | Ortega | |
| 5,287,887 | A | 2/1994 | Hengesbach et al. | |
| 5,310,095 | A | 5/1994 | Stern et al. | |
| 5,341,970 | A | 8/1994 | Woods | |
| 5,361,946 | A | 11/1994 | Ginther et al. | |
| 5,409,148 | A | 4/1995 | Stern et al. | |
| 5,409,166 | A | 4/1995 | Gunzel, Jr. et al. | |
| 5,415,351 | A | 5/1995 | Otto et al. | |
| 5,450,983 | A | 9/1995 | Stern et al. | |
| 5,476,879 | A | 12/1995 | Woods et al. | |
| 5,489,048 | A | 2/1996 | Stern et al. | |
| 5,505,344 | A | 4/1996 | Woods | |
| 5,524,798 | A | 6/1996 | Stern et al. | |
| 5,645,198 | A | 7/1997 | Stern et al. | |
| 5,715,975 | A | 2/1998 | Stern et al. | |
| 5,727,736 | A | 3/1998 | Tryon | |
| 5,775,446 | A * | 7/1998 | Lott | 175/424 |
| 5,803,360 | A | 9/1998 | Spitznagel | |
| 5,810,258 | A | 9/1998 | Wu | |
| 5,904,434 | A | 5/1999 | Bekius et al. | |
| 5,918,815 | A | 7/1999 | Wu | |
| 5,921,446 | A | 7/1999 | Stern | |
| 5,934,518 | A | 8/1999 | Stern et al. | |
| 5,979,797 | A | 11/1999 | Castellano | |
| 6,000,583 | A | 12/1999 | Stern et al. | |
| 6,012,651 | A | 1/2000 | Spitznagel | |
| 6,053,436 | A | 4/2000 | Morford | |
| 6,070,809 | A | 6/2000 | Price | |
| 6,092,740 | A | 7/2000 | Liu | |
| 6,105,882 | A | 8/2000 | Woltjen | |
| 6,116,473 | A | 9/2000 | Stern et al. | |
| 6,152,335 | A | 11/2000 | Stern et al. | |
| 6,168,093 | B1 | 1/2001 | Greer, Jr. et al. | |
| 6,213,410 | B1 | 4/2001 | Spitznagel | |
| 6,276,570 | B1 | 8/2001 | Stern et al. | |
| 6,328,185 | B1 | 12/2001 | Stern et al. | |
| 6,352,184 | B1 | 3/2002 | Stern et al. | |
| D455,761 | S | 4/2002 | Graber et al. | |
| 6,446,842 | B2 | 9/2002 | Stern et al. | |
| 6,536,633 | B2 | 3/2003 | Stern et al. | |
| 6,536,684 | B1 | 3/2003 | Wei | |
| 6,537,760 | B1 | 3/2003 | Bergmann et al. | |
| 6,712,292 | B1 | 3/2004 | Gosis et al. | |
| 6,726,125 | B1 | 4/2004 | Nonis et al. | |
| 6,845,923 | B1 | 1/2005 | Slotsve | |
| 6,863,227 | B2 | 3/2005 | Wollenberg et al. | |
| 7,172,413 | B2 * | 2/2007 | Han et al. | 431/350 |
| 2003/0010843 | A1 | 1/2003 | Liao | |
| 2004/0069816 | A1 | 4/2004 | Wollenberg et al. | |

FOREIGN PATENT DOCUMENTS

| | | |
|---|---|---|
| EP | 1 486 258 | 12/2004 |
| EP | 1511575 A1 | 3/2005 |
| GB | 0591609 | 8/1947 |
| GB | 0714522 | 9/1954 |
| GB | 2 372 226 | 8/2002 |
| WO | 03106042 A1 | 12/2003 |

OTHER PUBLICATIONS

Instruction-Parts List for Texture Spray Gun, Graco Inc., 2 pp., 1998.
Product Information, "Cleaning/Paint Supplies- Homax Pneumatic II Spray Texture Gun (4610)," Ace Hardware, http://www.acehardware.com, 1 pg., 2005.
Product Information, "Painting- Air Texture Gun Sprays Liquid Drywall Materials," Northern Tool + Equipment, http://www.northerntool.com, 2 pp.
Product Information- "Discount Air Texture Spray Gun," Front Range Tool Warehouse, http://www.dropshipdiscounttools.com, 1 pp.
Product Information, "Graco Professional Hopper Gun," O-Gee Paint Co., http://www.o-geepaint.com, 2 pp.
UK Intellectual Property Office Search Report dated Jul. 26, 2007.
Supplemental Search Report from GB Application No. 0707861.1, dated Nov. 14, 2007, 3 pages.
English Translation of Office Action for Chinese Application No. 200710138501.6, 5 pages, issued on Jun. 12, 2009.
Search Report issued in French Application No. 0754703, dated Jul. 22, 2010, 9 pages.

* cited by examiner

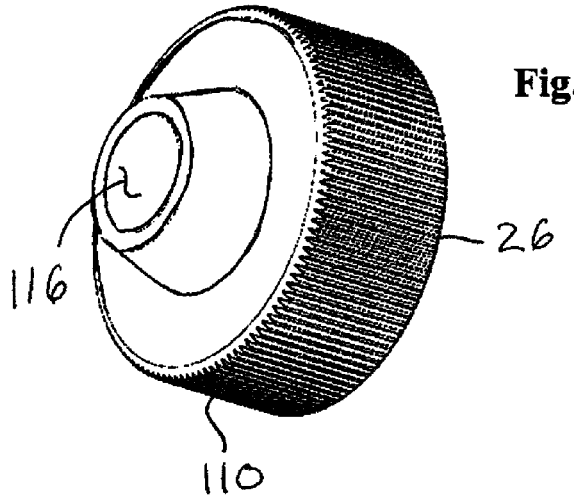
Fig. 11
Fig. 12
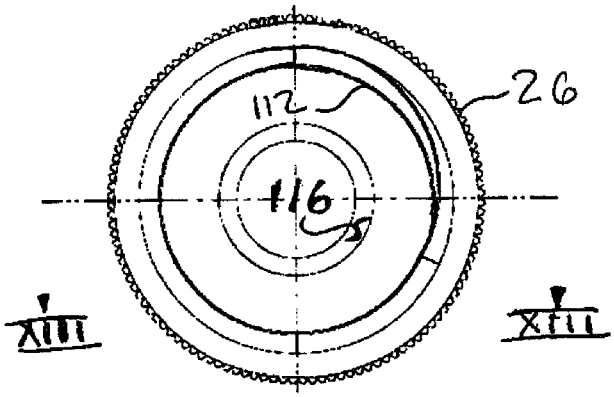
Fig. 13
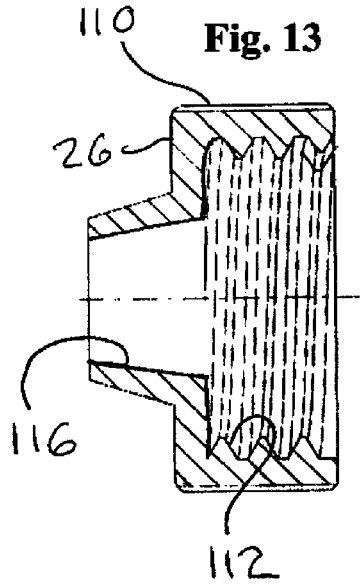

TEXTURE SPRAYER NOISE REDUCER

CROSS-REFERENCE TO RELATED APPLICATION

This application is a Continuation-In-Part of application Ser. No. 11/411,644 filed Apr. 26, 2006, the entire contents of which are hereby expressly incorporated by reference.

BACKGROUND OF THE INVENTION

This invention relates to the field of texture sprayers used to apply a texture coating to ceilings and the like. More particularly, this invention relates to apparatus and method for reducing noise in a texture sprayer.

In the past, texture sprayers were in the form of either a hand-held pressurized can of material (for patching existing ceilings) or a relatively large floor-based pump with a hand held spray gun connected to the pump via one or more hoses, with a material hopper either on the pump or the gun. Typically floor-based units had a source of pressurized air remote from the gun, while the pressurized cans contained both the texture material and a pressurized gas to deliver it. As is readily apparent, the floor-based units were large and expensive, and while suitable for commercial use, such units were not attractive to consumers for those reasons. The pressurized cans were not suitable for anything other than patching existing textured surfaces, since such pressurize cans have very limited capacity, e.g. with time to total discharge measured in seconds and thus such units were not attractive to consumers desiring to apply texture to a substantial area. The above shortcomings of prior art texture sprayers has led to the development of a hand held texture sprayer, while not prior art, is the environment in which the present invention is particularly, but not necessarily exclusively, applicable.

BRIEF SUMMARY OF THE INVENTION

The present invention is a texture sprayer noise reducer for a texture sprayer, particularly directed to, but not necessarily limited to, a hand-held texture sprayer in the form of a completely self-contained, entirely hand-held unit that includes a hopper, spray gun, and blower to propel the material toward the surface to be coated.

In one aspect, the present invention includes a noise reducer for a texture sprayer for spraying texture material having a body and an on-board pressurized air source mounted on the body, a texture material hopper mounted on the body, and a texture delivery nozzle extending from the body for selectively spraying texture material from the hopper through a texture material passageway to a surface to be coated by propelling the texture material using pressurized air from the pressurized air source passing through a hollow through bore in a plunger before impinging on the texture material.

More particularly, the present invention includes a plurality of radially inwardly projecting structures at an exit of a through bore in the plunger.

The structures may be made up of a plurality of prongs.

In another aspect, the invention may include a method of reducing noise generated in an air flow path of a texture sprayer by interposing a plurality of radially inwardly directed prongs at an exit of a hollow through bore of a plunger in the form of a frustro-conical sleeve is movable along a nozzle cone axis to open and close the texture material passageway.

BRIEF DESCRIPTION OF THE SEVERAL VIEWS OF THE DRAWINGS

FIG. 11 is a perspective view of a nozzle useful in the practice of the present invention.

FIG. 12 is a front elevation view of the nozzle of FIG. 11.

FIG. 13 is a section view taken along line XIII-XIII of FIG. 12.

DETAILED DESCRIPTION OF THE INVENTION

Figure 1:
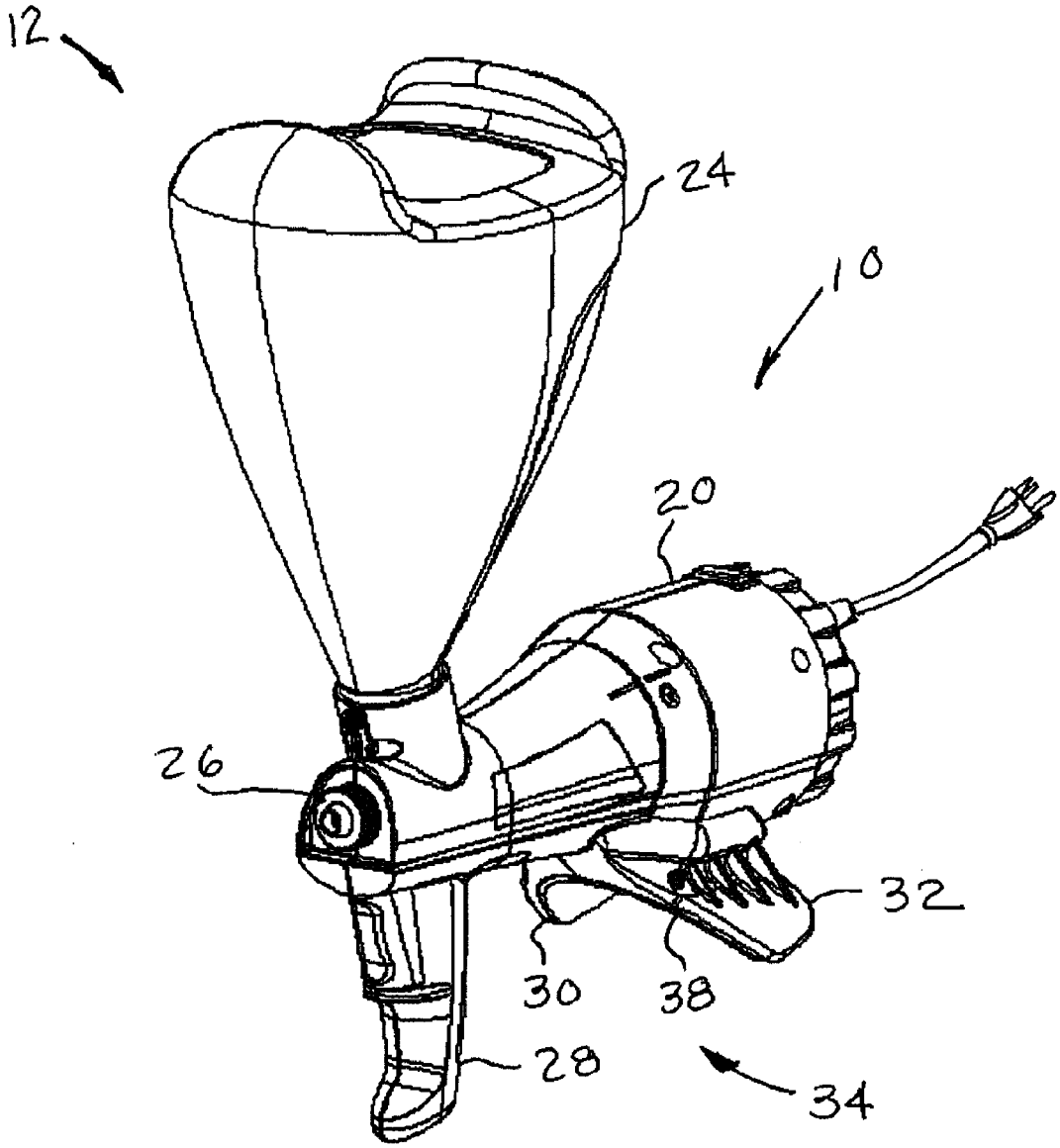
FIG. 1 is a perspective view of a first embodiment of a hand-held apparatus for spraying texture material.

Referring now to the drawings, and most particularly to FIGS. 1, 5, 6, 7 et seq. a first embodiment 10 of a texture sprayer 12 useful to carry out the present invention may be seen. A second embodiment 14 of the texture sprayer 12 may be seen in FIGS. 2, 3, and 4, with the difference between the first and second embodiments being that the second embodiment 14 has a larger diameter rearwardly located air source 16 and has a stirrup shaped handle 18 to assist a user in removal of the air source 20. The first embodiment 10 has a smaller diameter air source 20 and thus permits grasping the air source 20 directly for removal and installation. It is to be understood that the construction, use, operation and remaining features of the first and second embodiments 10 and 14 are essentially the same; because of this only the first embodiment 10 will be described in detail.

Figure 2:
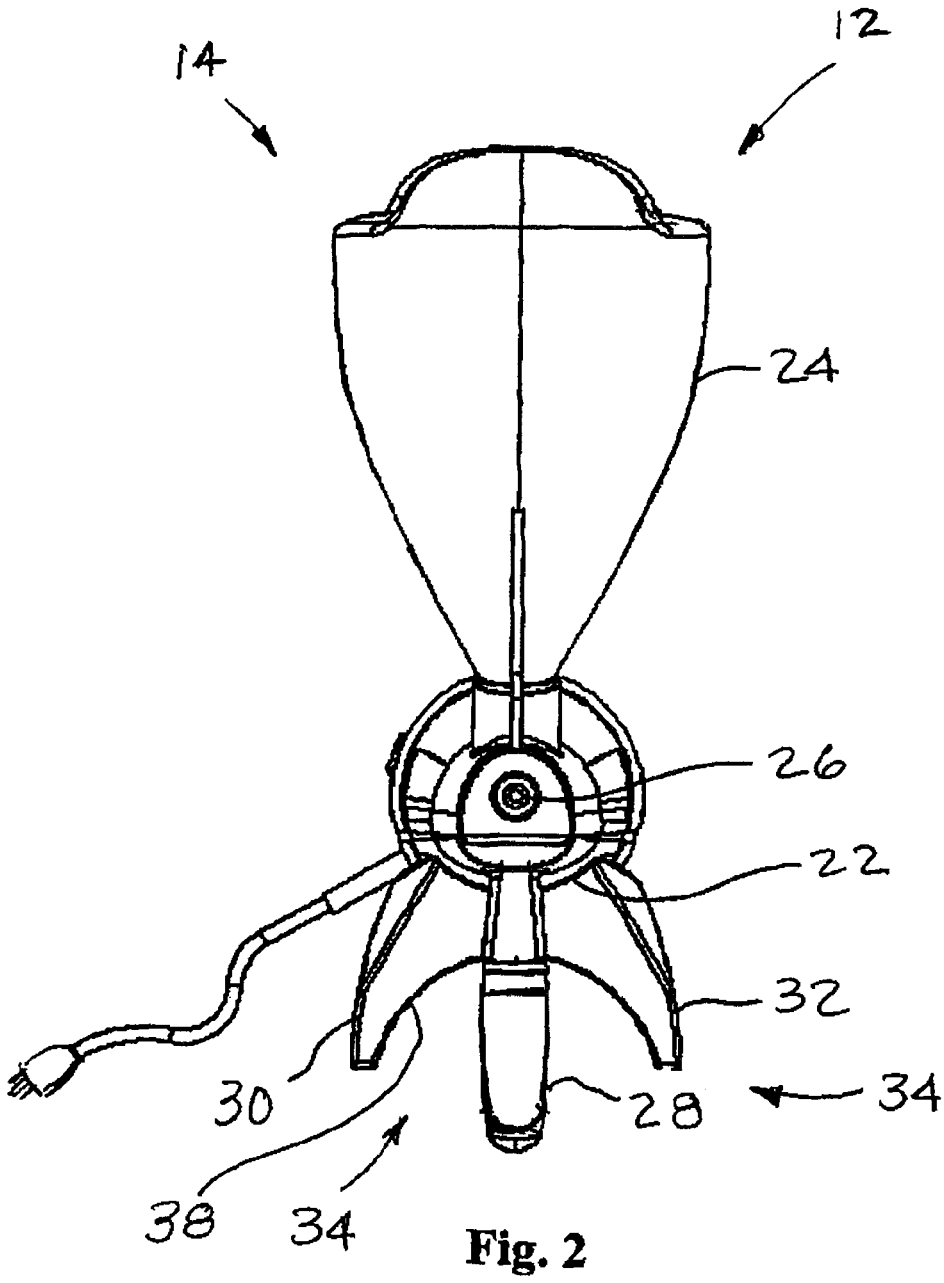
FIG. 2 is a front elevation view of the apparatus of FIG. 1.
Figure 3:
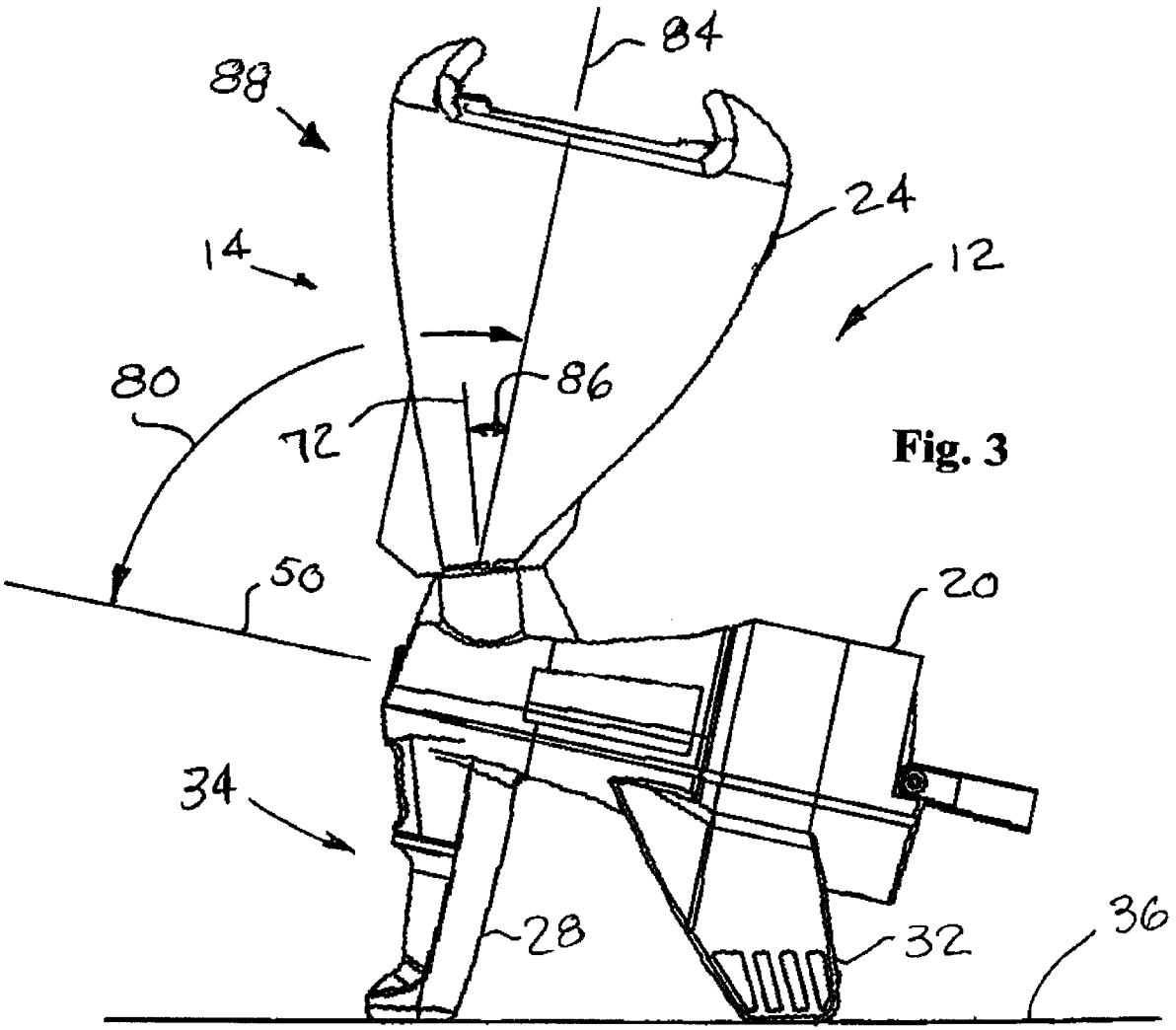
FIG. 3 is a side elevation view of the apparatus of FIGS. 1 and 2, shown resting on a horizontal surface such as a floor, with a hopper in a first position.

The texture sprayer of the present invention is a hand-held apparatus 12 for spraying texture material. The apparatus 12 has a body 22 and a pressurized air source 20 (or 16) removably mounted on the body. The texture sprayer 12 also has a texture material hopper 24 mounted on the body 22 and a texture delivery nozzle 26 extending from the body 22 for selectively spraying texture material from the hopper 24 through a texture material passageway interior of the body to a surface to be coated by propelling the texture material using pressurized air from the pressurized air source. Referring to FIGS. 2 and 3, the apparatus 12 has a forwardly located pistol grip 28 and a rearwardly located pair of legs 30, 32 forming a tripod type support structure 34 for the apparatus 10 such that the apparatus 10 may be placed on a horizontal surface such as a floor 36 and remain upright for filling the hopper 24. This feature is in contrast to prior art sprayers which typically either had a hopper that remained attached to equipment (typically a pump) supported on the floor during operation or had a hopper that remained attached to a hand-held gun that had, at most, a pistol grip, thus necessitating some external support to fill the hopper. With such a prior art arrangement, either two persons were needed to fill the hopper, with one holding the gun and hopper and the other pouring the material into the hopper, or else a single user was required to (precariously) balance the gun on the pistol grip by propping it against an external surface, for example, a wall, to fill the hopper, or else use one hand to hold the gun and hopper and the other hand to pour material into the hopper. The present invention, in this aspect, overcomes these shortcomings of the prior art by providing a stable supporting structure inherent in the hand-held texture sprayer itself, especially useful in providing a self-supporting feature for use while filling the hopper.

Figure 4:
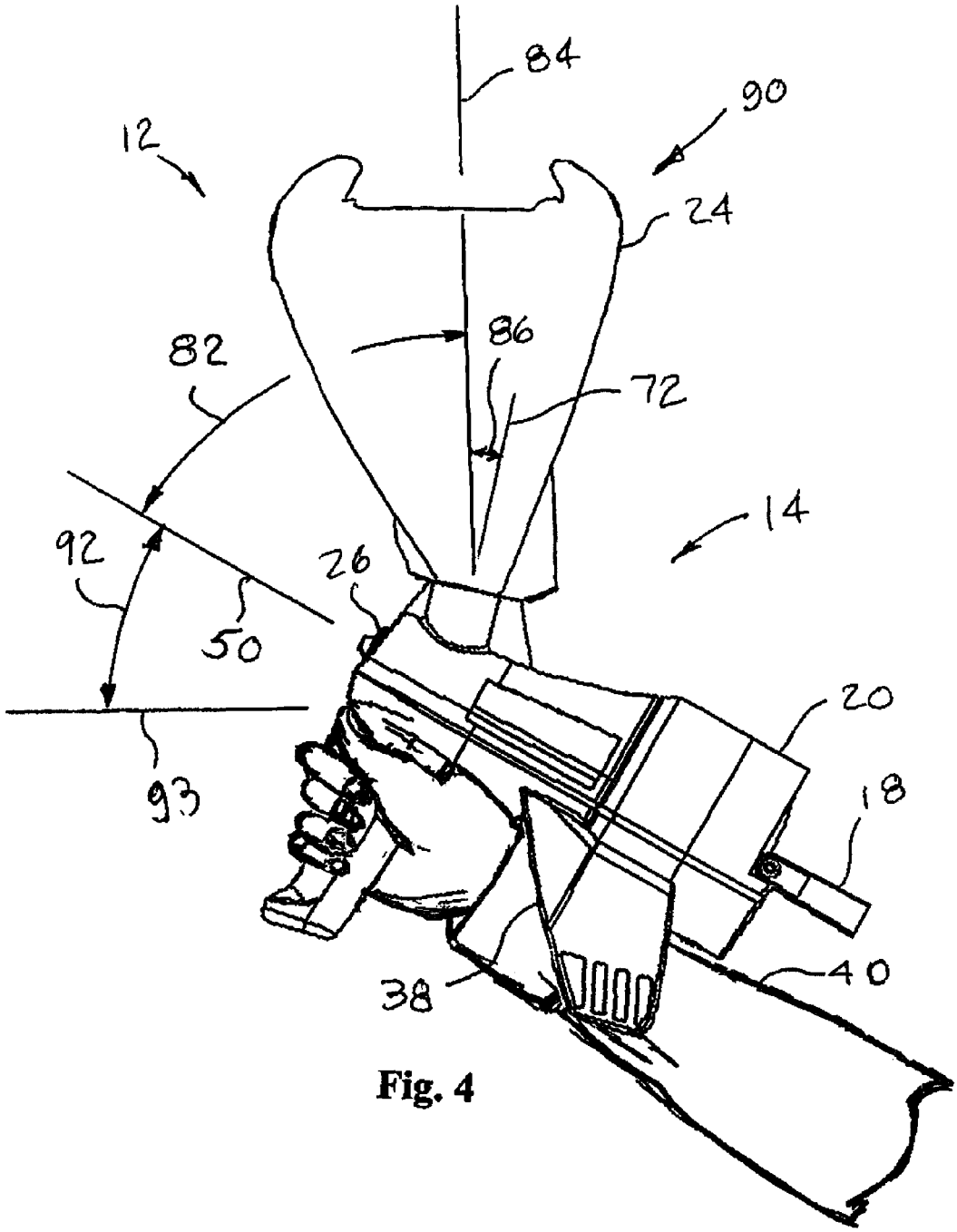
FIG. 4 is another side view of the apparatus of FIGS. 1-3, except shown supported by a hand and arm of an operator, with the hopper in a second position and with the apparatus angled upward to spray texture material on an overhead surface.
Figure 5:
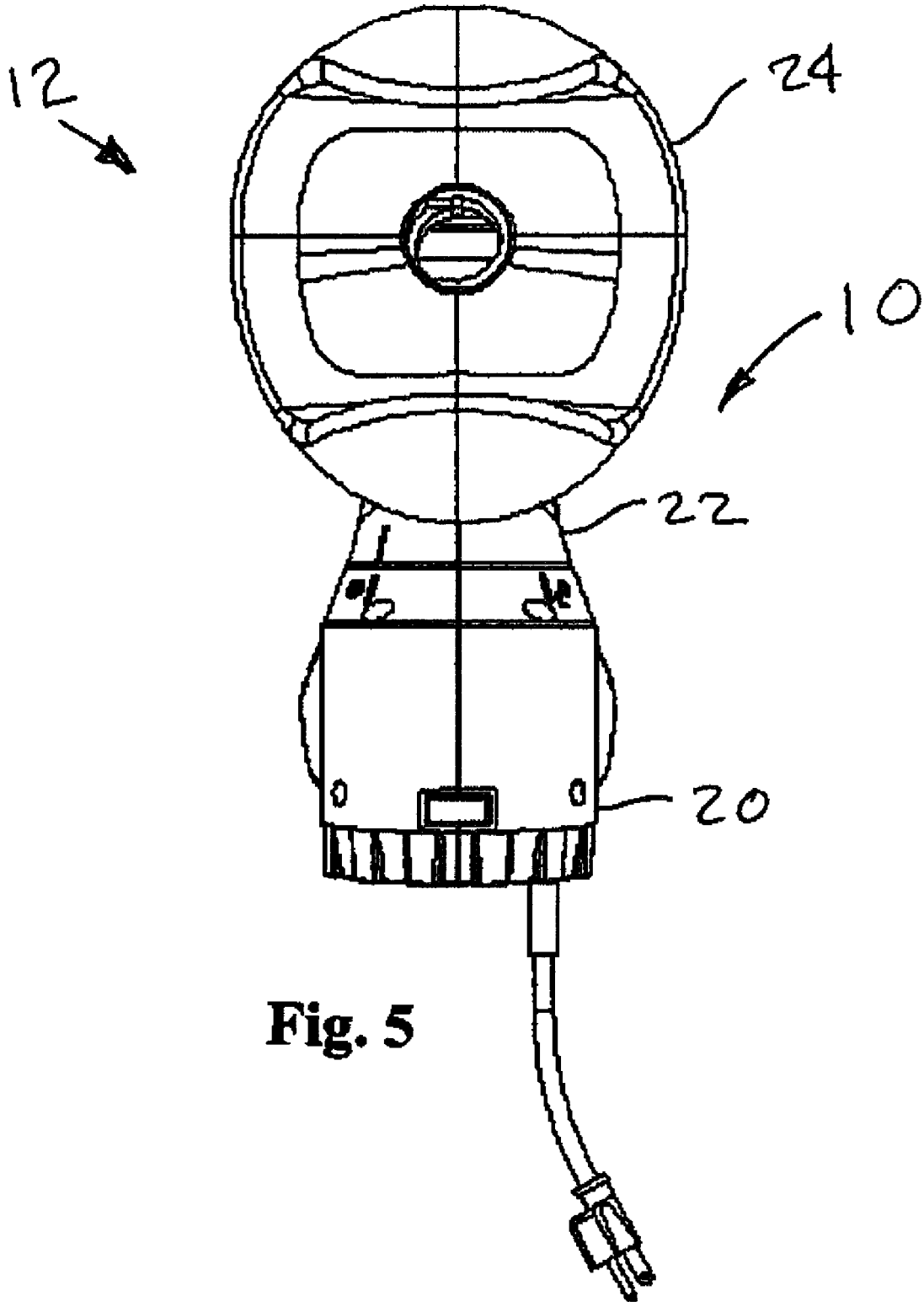
FIG. 5 is a top plan view of a second embodiment of the apparatus for spraying texture material useful in the practice of the present invention.
Figure 6:
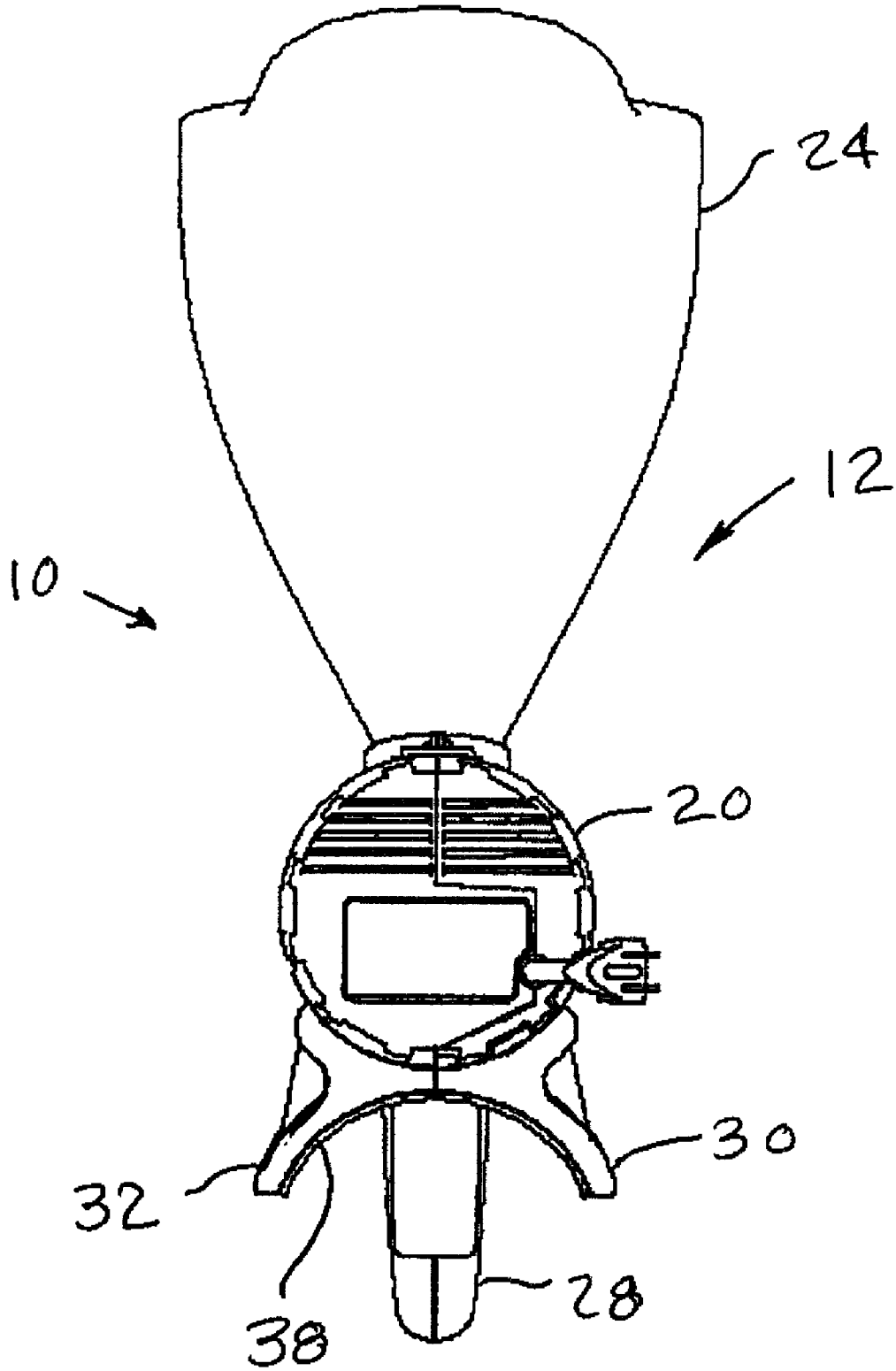
FIG. 6 is a rear elevation view of the apparatus of FIG. 5.

Additionally, the legs 30 and 32 in the hand-held texture sprayer or apparatus 12 may form an arm rest 38 supporting the apparatus 12 on a user's forearm 40 when the pistol grip 28 is grasped by the user, as may be seen in FIG. 4.

Figure 7:
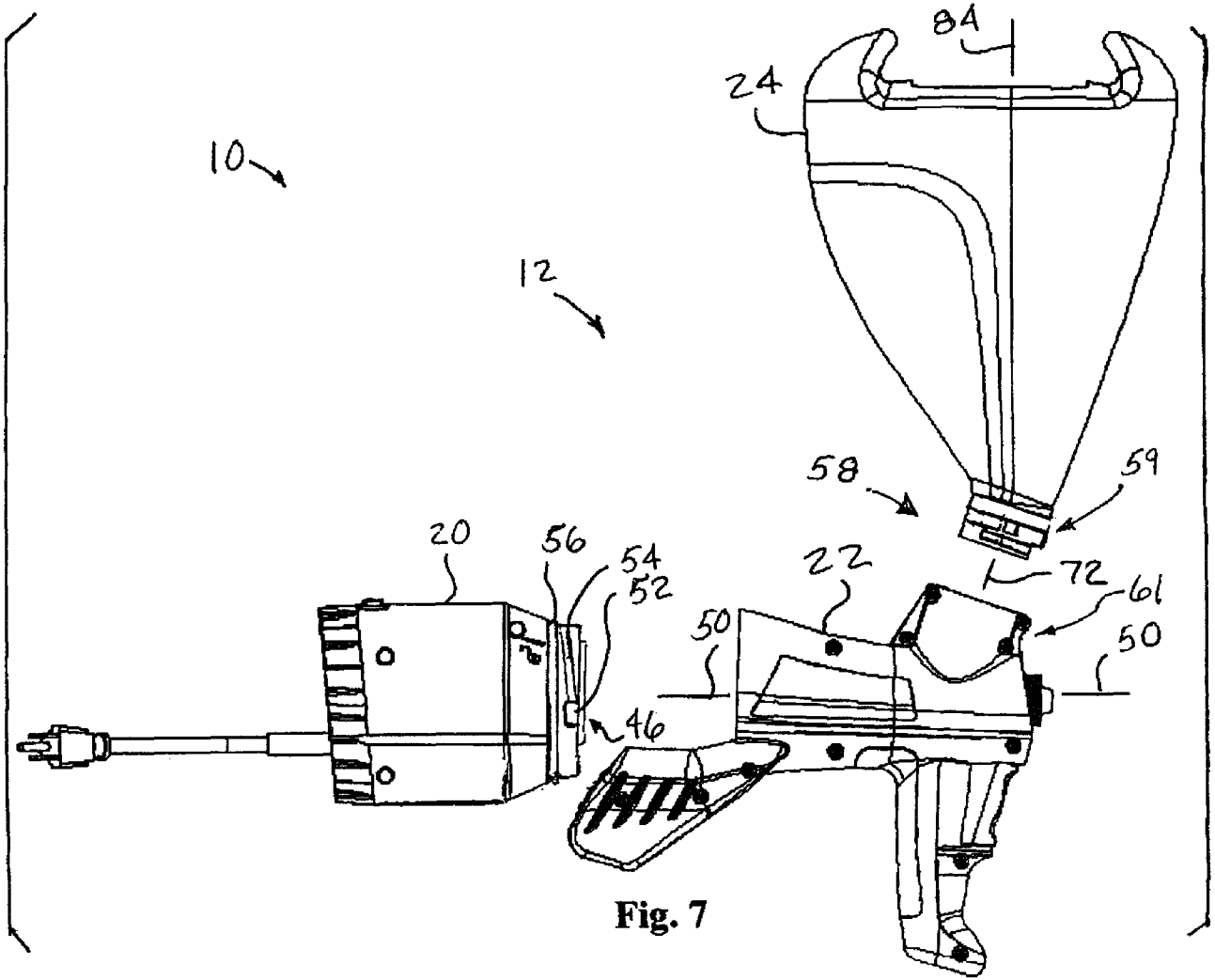
FIG. 7 is a side elevation view of the apparatus of FIGS. 5 and 6, with an air source and the hopper each disengaged from the remainder of the apparatus.
Figure 8:
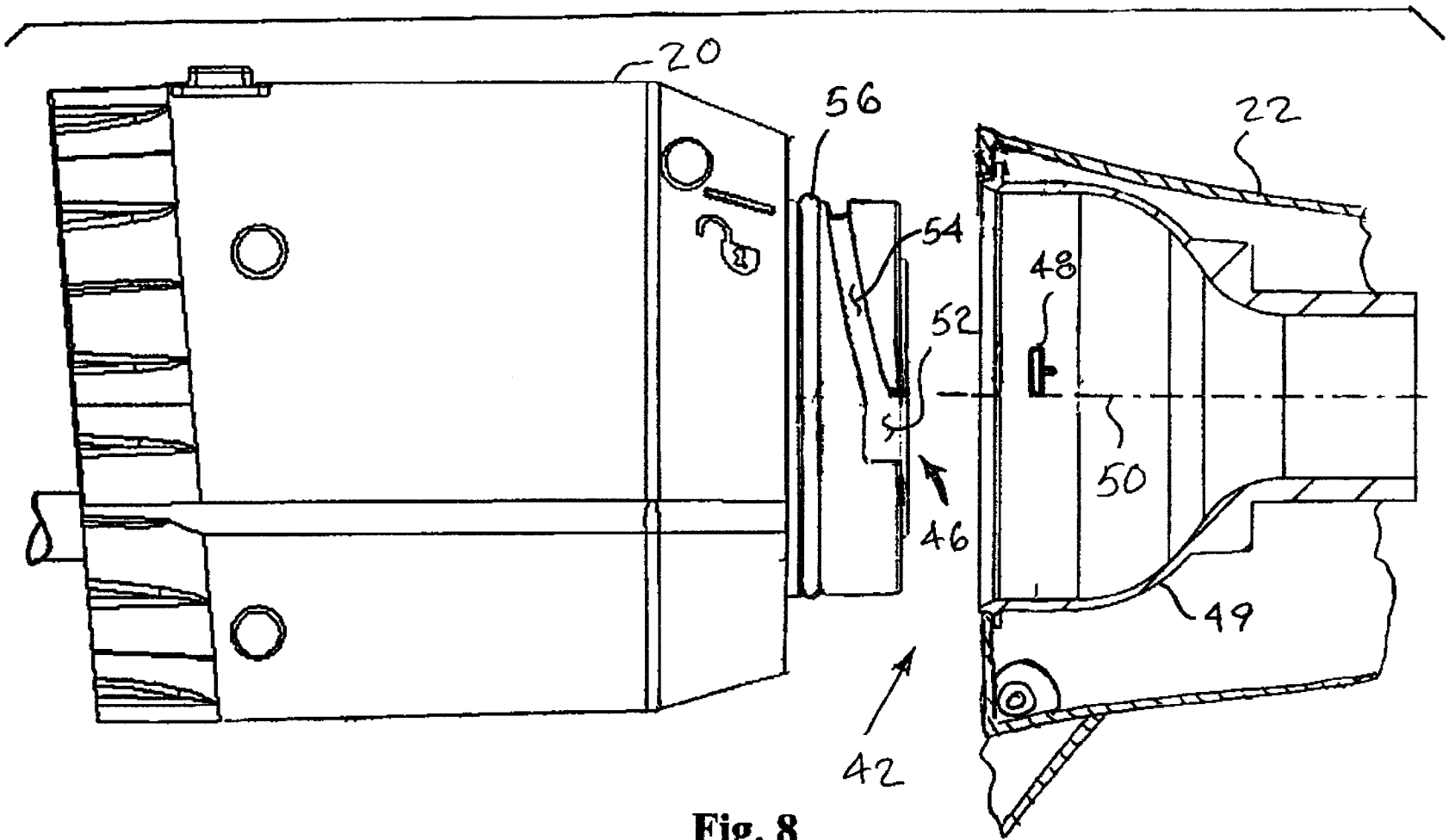
FIG. 8 is an enlarged fragmentary side view, partly in section, to illustrate details of a first manual connection feature of the present invention.

Referring now to FIGS. 7 and 8, the texture sprayer also includes an air source connection structure 42 located between the pressurized air source and the body wherein the air source connection structure is operable to connect and disconnect the pressurized air source to and from the body without the use of tools. The air source connection structure 42 may be in the form of a bayonet interlock 44 removably securing the pressurized air source 20 to the body 22. The bayonet interlock may include a recess 46 on the air source 20 and a protrusion 48 on the body 22. More particularly, the recess 46 is located on the exterior of the air source 22 and is engageable with the protrusion 48 located on an interior surface of a texture chassis 49, which is an internal part of the body 22. To assemble the air source 20 to the body 22, the air source 20 is manually moved axially along an axis 50 toward the body 22 with an opening 52 of the recess 46 aligned with the protrusion 48 until the protrusion 48 is engaged with the recess 46 at the opening 52. The air source 20 is then manually rotated with respect to the body 22, causing the protrusion to move into a helical channel 54 of the recess 46, drawing the air source 20 into close and secure connection with the body 22. An O-ring 56 seals the air source 20 to the body 22. It is to be understood that the protrusion may be mounted on the air source and the recess formed in the body, if desired.

Figure 9:
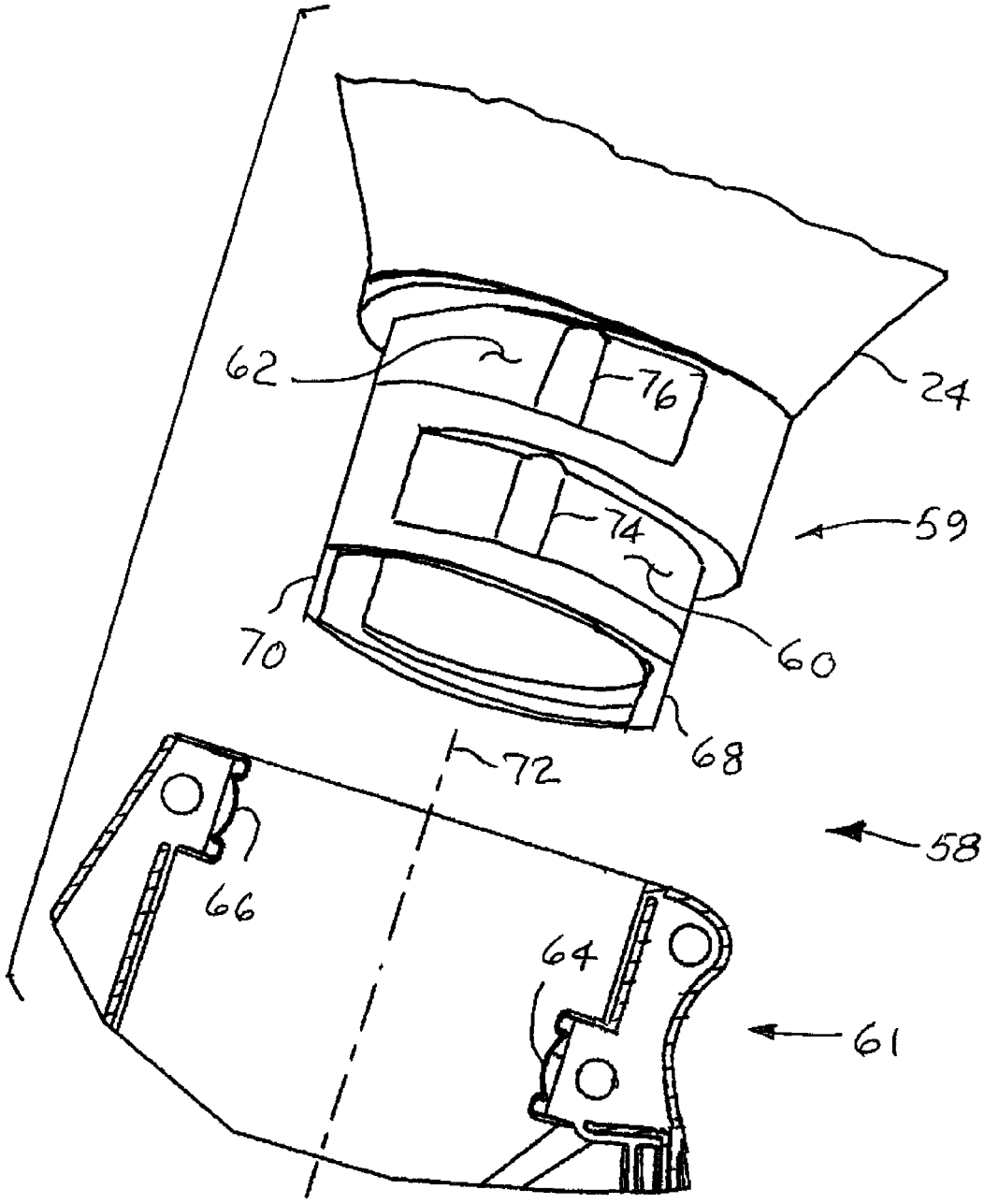
FIG. 9 is an enlarged fragmentary side view, partly in section, to illustrate details of a second manual connection feature of the present invention.

In another aspect, and now referring additionally to FIG. 9, the invention may further include a material connection structure 58 formed of a fitting 59 on the hopper 24 and a mating fitting 61 on the body 22. The material connection structure 58 is located between the texture material hopper 24 and the body 22. The material connection structure 58 is operable to connect and disconnect the texture material hopper 24 to and from the body 22 without the use of tools.

In one embodiment, illustrated in FIG. 9 the fitting 59 of the material connection structure 58 includes eccentric surfaces 60, 62 on the hopper 24. The material connection structure 58 also includes a mating fitting 61 which includes offset, diametrically opposed projections 64, 66 on the body 22. The surface 60 engages the projection 64 and surface 62 engages the projection 66 when the hopper is fully engaged with the body 22. To attach the hopper 24 to the body 22, flats 68 and 70 are aligned with projections 64 and 66, and the hopper 24 is moved toward the body 22 along a cylinder axis 72. Once the hopper 24 is seated in the body 22, the hopper 24 may be rotated 90 degrees in either direction, to lock the hopper to the body by engaging surface 60 with projection 64 and simultaneously engaging surface 62 with projection 66. As the hopper 24 is rotated with respect to the body 22, one of a pair of first detents 74 will move past projection 64 and one of a pair of second detents 76 will move past projection 66, to secure the hopper 24 to the body 22.

Turning the hopper 24 in one direction will result in the hopper 24 tilted to a first angle 80 with respect to the axis 50, as shown in FIG. 3. Turning the hopper 24 in the opposite direction will result in the hopper 24 being tilted in to a second angle 82 with respect to the axis 50, as shown in FIG. 4. The first angle 80 is useful for filling the hopper and for directing a spray pattern of the texture sprayer along axis 50 from generally horizontal to angles below horizontal. The second angle 82 is useful for spraying at angles from generally horizontal up to generally vertical, and is particularly useful for spraying surfaces or portions of surfaces above the height of the nozzle of the texture sprayer as it is being used. It is to be understood, however that the sprayer 12 is stable and can be filled with the hopper 24 positioned at angle 82 as well as at angle 80.

The hopper 24 is preferably a generally cone-shaped structure having a conic axis 84 positioned at an angle with respect to the cylinder axis 72 of the material connection structure 58. The fitting 59 of the material connection structure 58 is preferably rotatable about axis 72 to allow positioning of the conic axis 84 of the cone-shaped structure at a location in a cone-shaped path such that the hopper may be rotated to a first position 88 (shown in FIG. 3) wherein the conic axis 84 is directed generally vertically when the body 22 and nozzle 26 directed in a horizontal direction along spray axis 50 (as may be seen in FIG. 7), and (alternatively) to a second position 90 (shown in FIG. 4) wherein the conic axis 84 is oriented generally vertically when the body 22 and nozzle 26 and spray axis 50 are directed upward above a horizontal reference 93, at an angle 92 of, for example, 30 degrees to the horizontal, which has been found to be a comfortable angle for positioning the forearm 40 while spraying an elevated surface.

Figure 10:
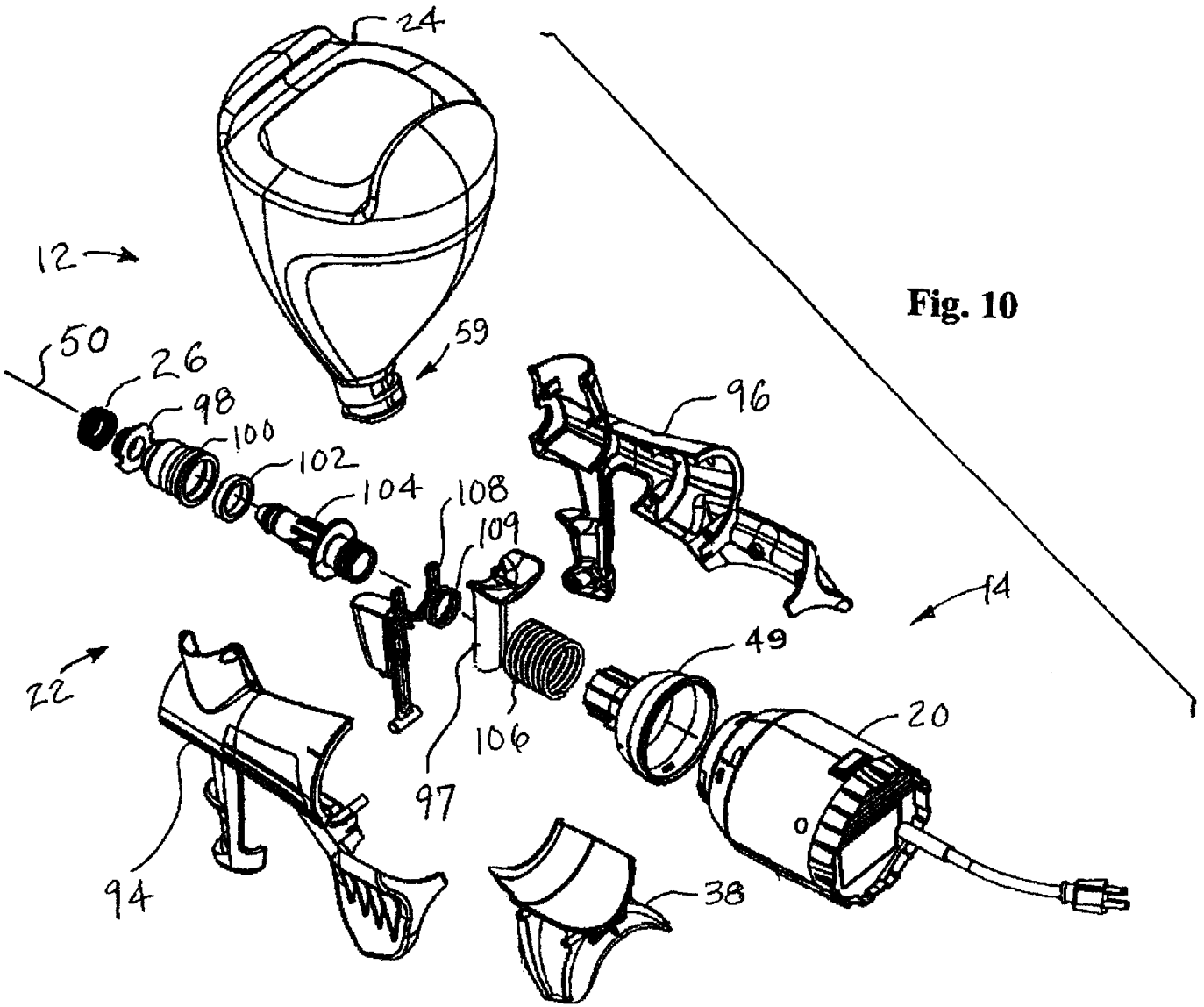
FIG. 10 is an exploded view of the apparatus of FIGS. 5-7.

Referring now also to FIG. 10, an exploded view of the main parts of the texture sprayer 12 of the present invention may be seen. The air source 20 and hopper 24 are shown along with parts of body 22. Body 22 includes left and right gun shell halves 94, 96, which together with a handle insert 97 form the pistol grip 28 and covering portions for the arm rest 38. The nozzle 26 is shown along with a nozzle plate 98, a boot 100 and a bushing 102. A plunger 104 is urged forward against the nozzle plate 98 by a spring 106 and is retractable away from the nozzle plate by a trigger assembly 108. A pair of O-rings 109 are received in grooves on the rear of plunger 104 to seal plunger against the chassis 49.

Figure 14:
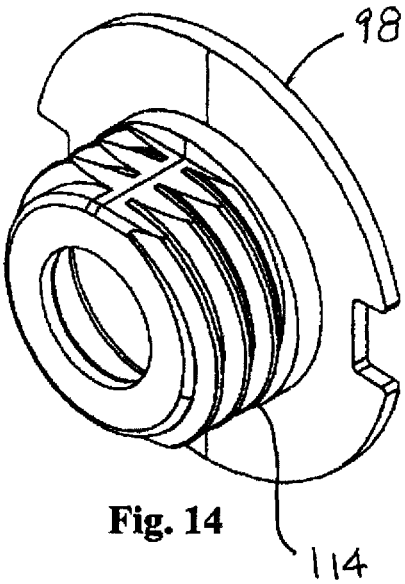
FIG. 14 is a perspective view of a nozzle plate useful in the practice of the present invention.
Figure 15:
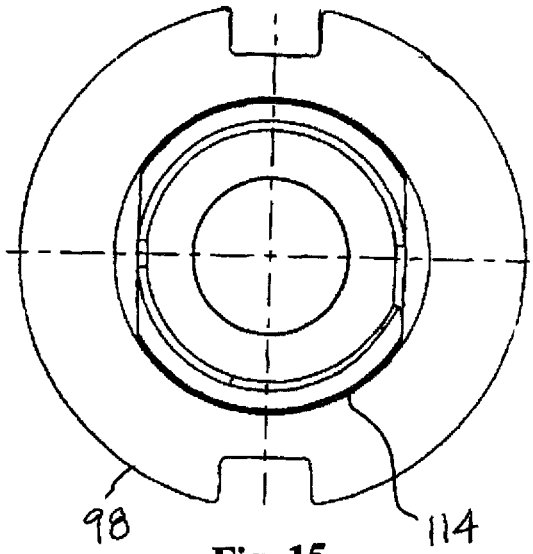
FIG. 15 is a rear elevation view of the nozzle plate of FIG. 14.
Figure 16:
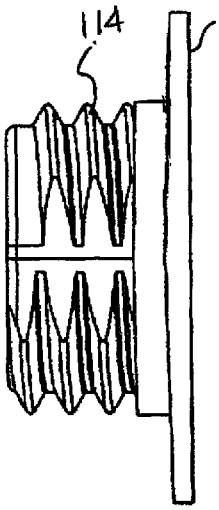
FIG. 16 is a first side view of the nozzle plate of FIG. 14.
Figure 17:
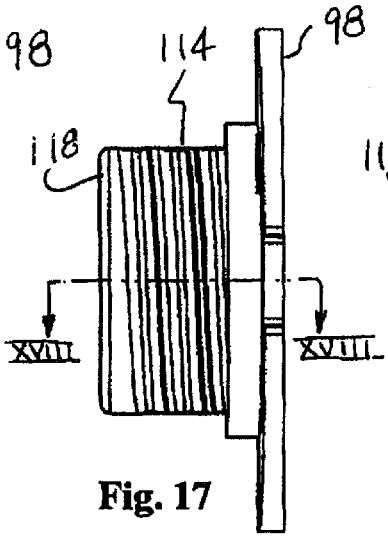
FIG. 17 is a second side view taken at 90 degrees from that of FIG. 16 of the nozzle plate of FIG. 14.
Figure 18:
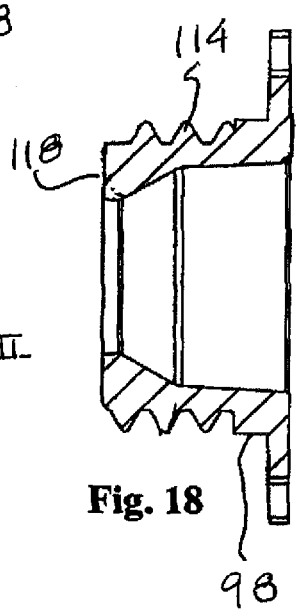
FIG. 18 is a section view of the nozzle plate taken along line XVIII-XVIII of FIG. 17.
Figure 19:
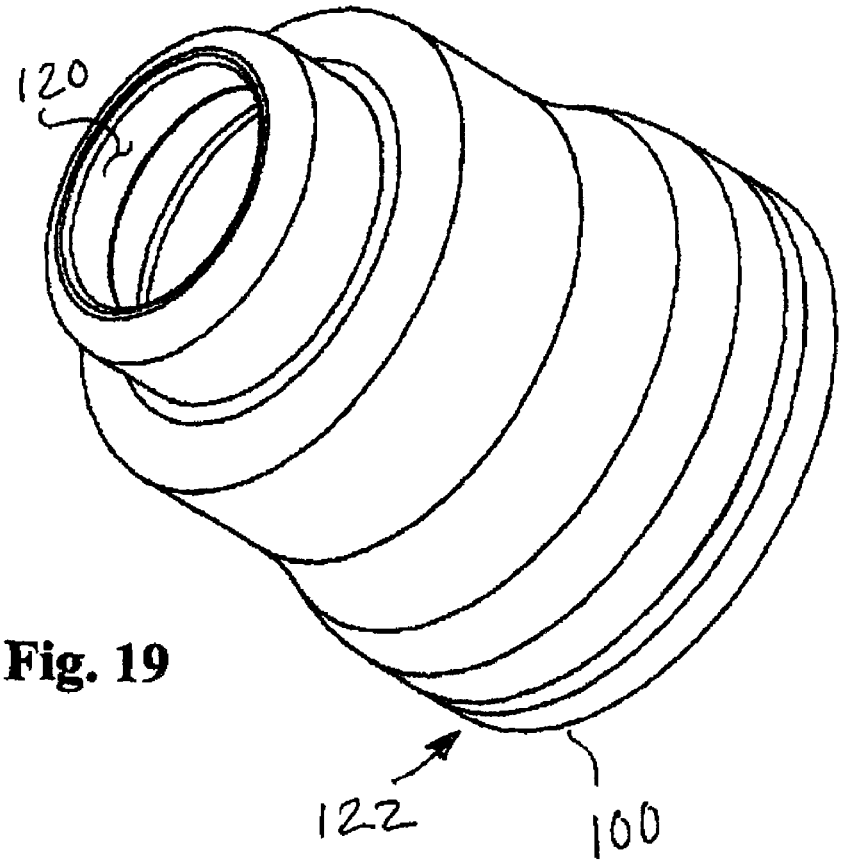
FIG. 19 is a perspective view of an elastomeric boot useful in the practice of the present invention.
Figure 20:
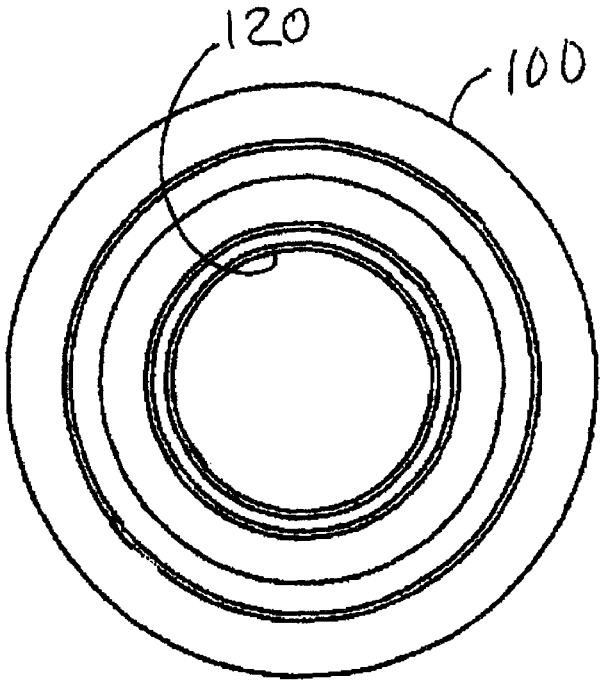
FIG. 20 is an end view of the boot of FIG. 19.
Figure 21:
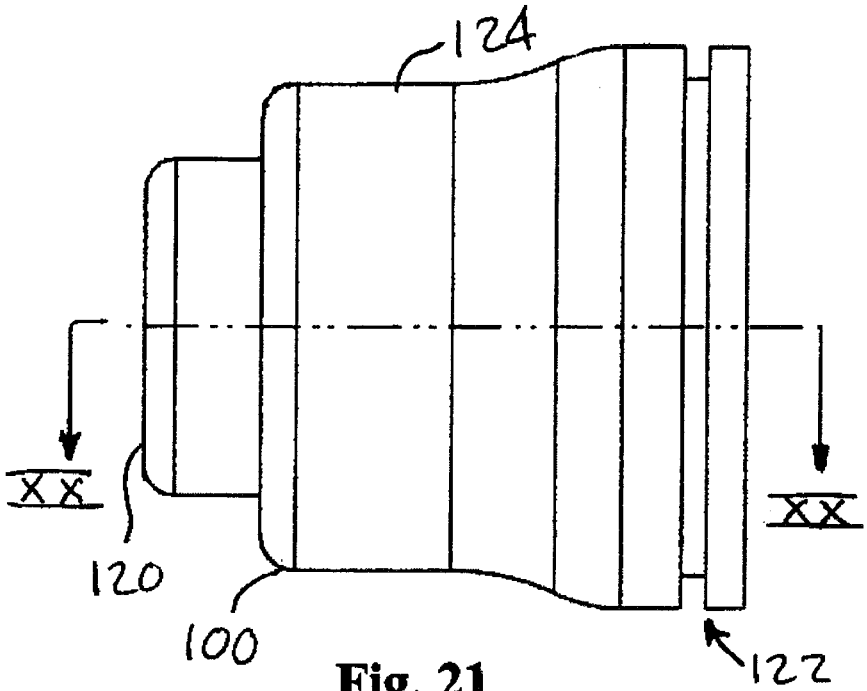
FIG. 21 is a side view of the boot of FIG. 19.
Figure 22:
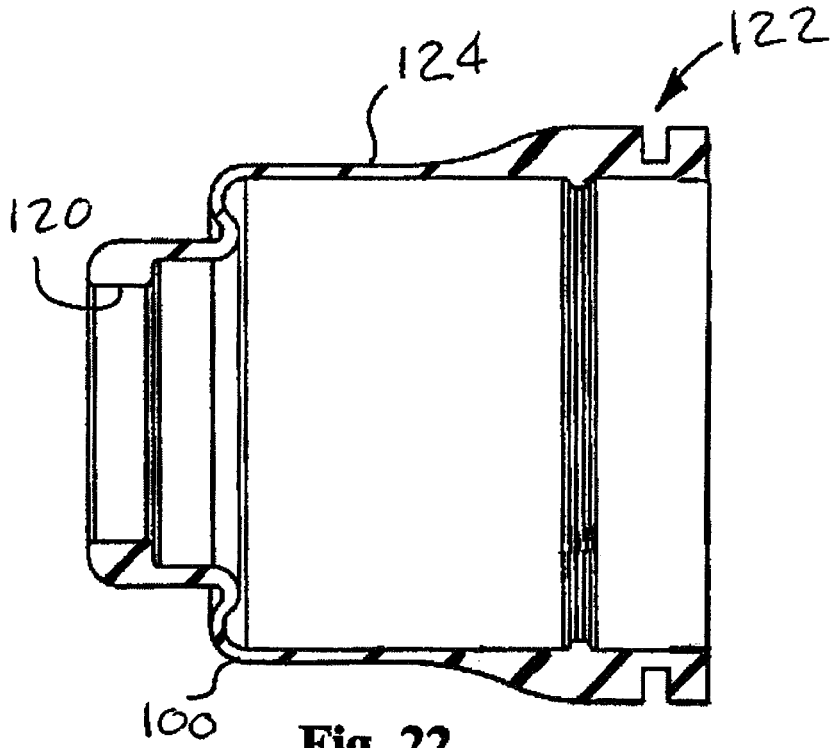
FIG. 22 is a section view taken along line XX-XX of FIG. 21.
Figure 23:
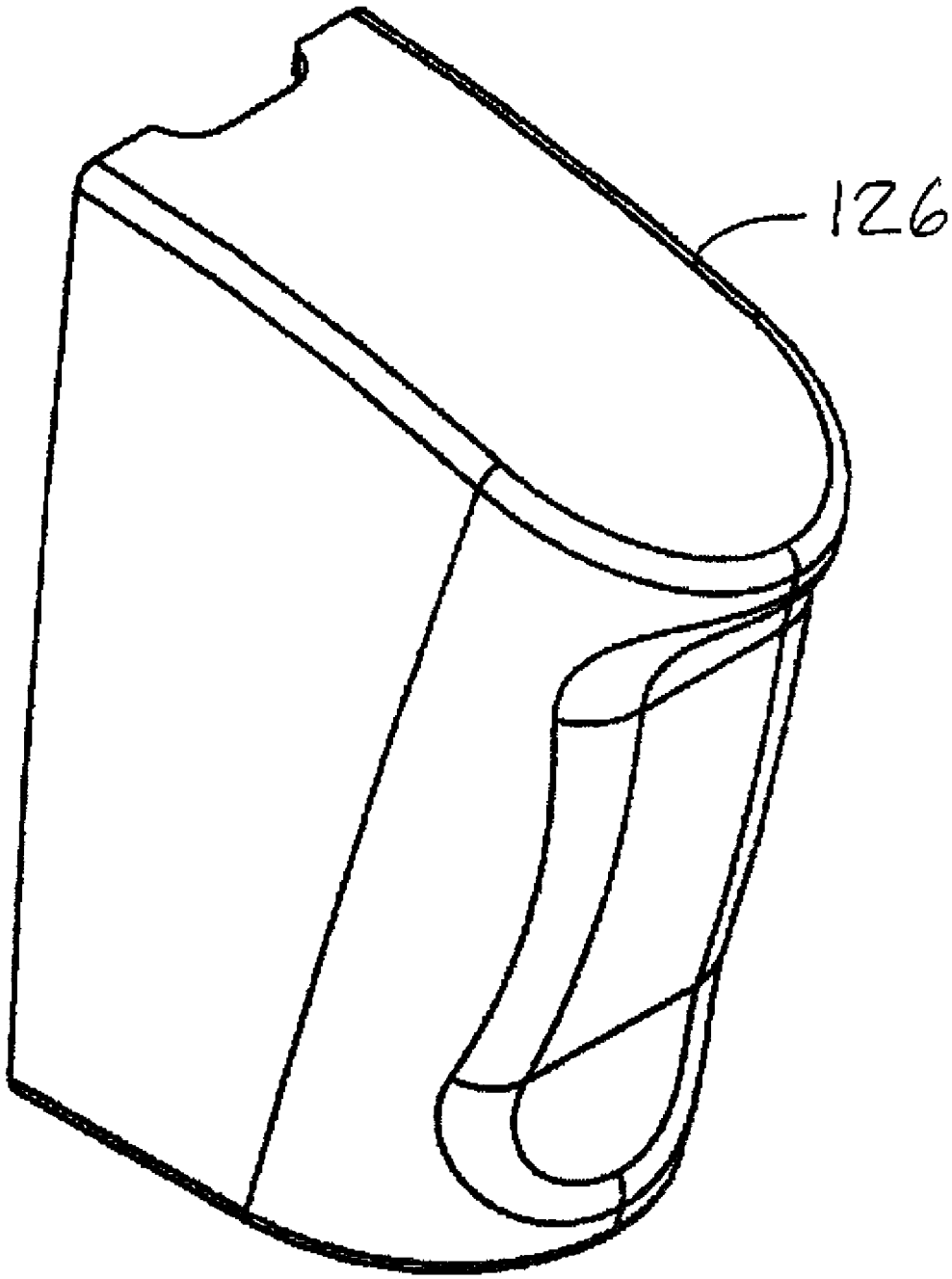
FIG. 23 is a perspective view of a trigger button useful in the practice of the present invention.
Figure 25:
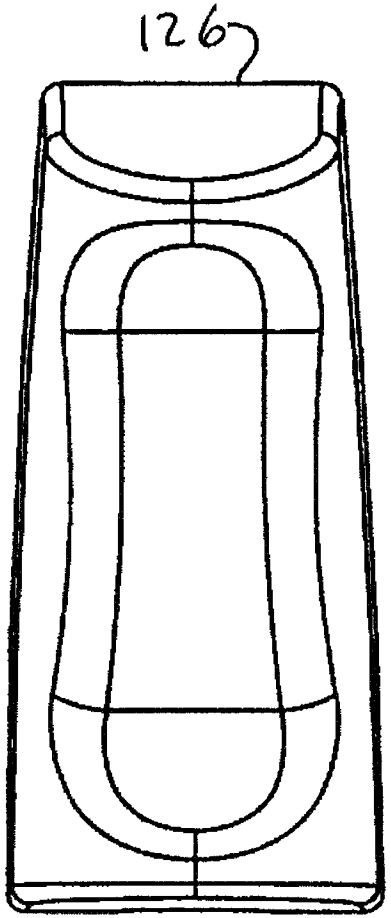
FIG. 25 is a front elevation view of the trigger button of FIG. 23.
Figure 24:
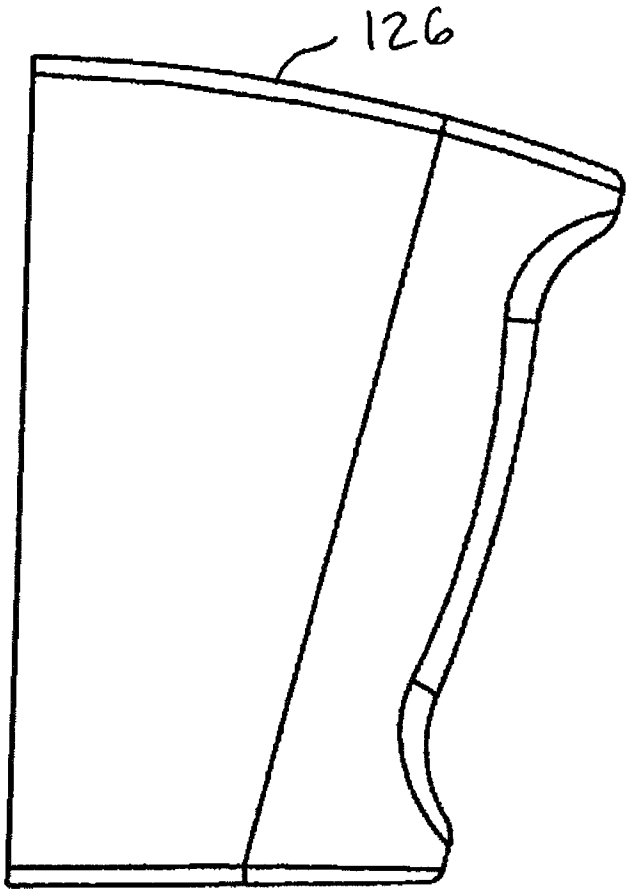
FIG. 24 is a side elevation view of the trigger button of FIG. 23.
Figure 27:
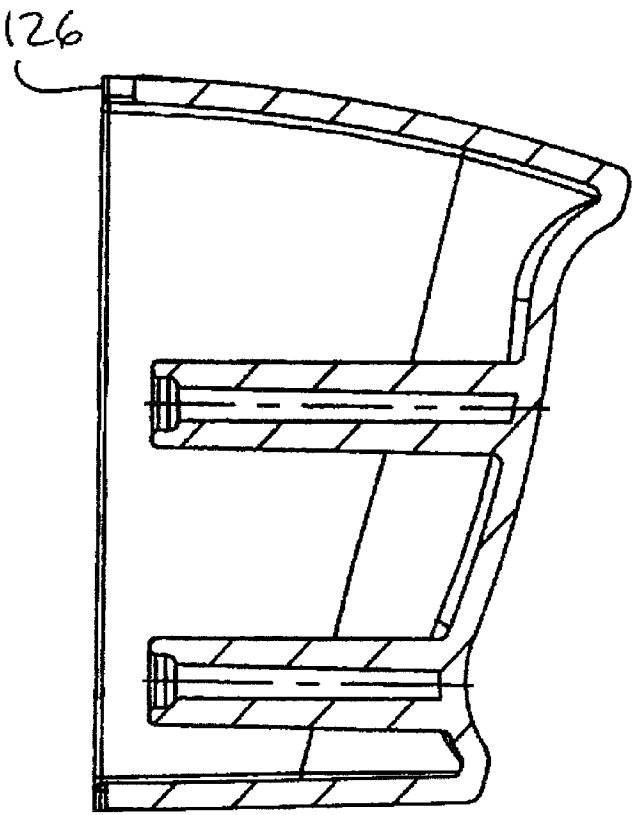
FIG. 27 is a section view taken along line XXVII-XXVII of FIG. 26.
Figure 26:
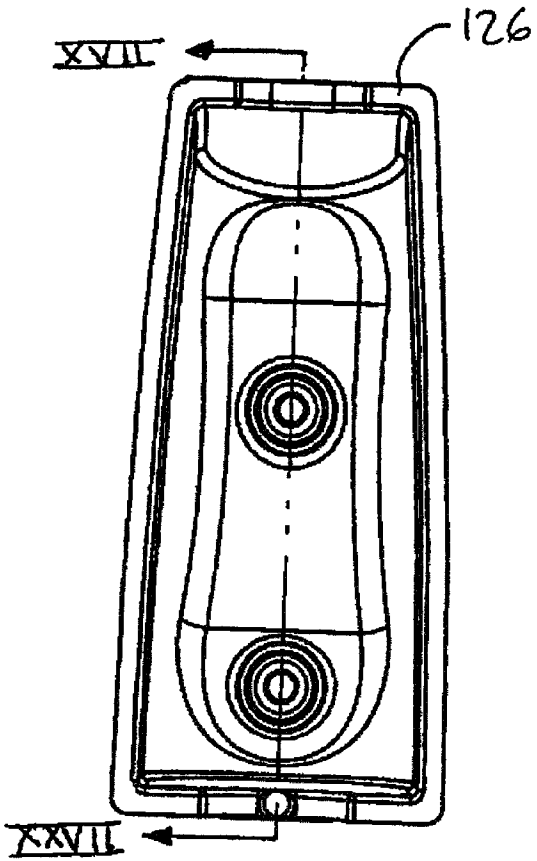
FIG. 26 is a rear elevation view of the trigger button of FIG. 23.
Figure 30:
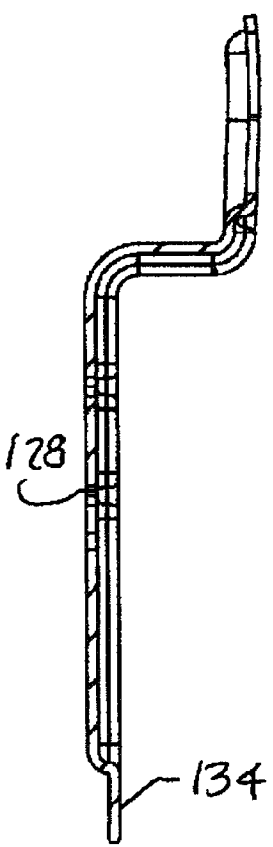
FIG. 30 is a section view along line XXX-XXX of FIG. 29.
Figure 29:
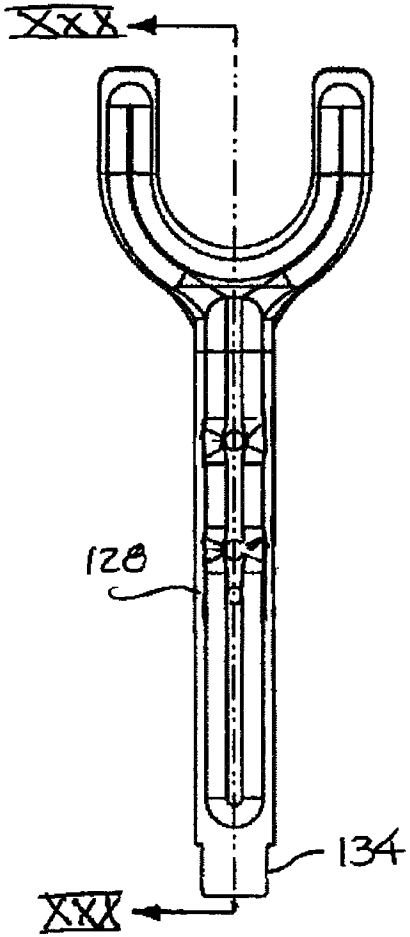
FIG. 29 is a front view of the trigger of FIG. 28.
Figure 28:
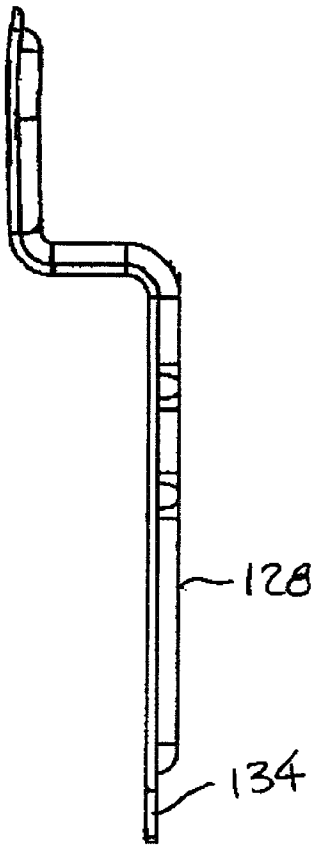
FIG. 28 is a side view of a trigger useful in the practice of the present invention.
Figure 32:
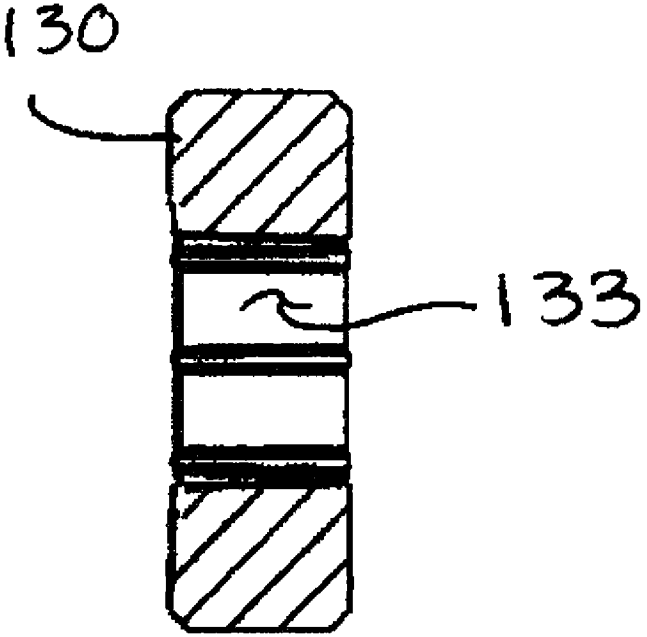
FIG. 32 is a section view taken along line XXXII-XXXII of FIG. 31.
Figure 31:
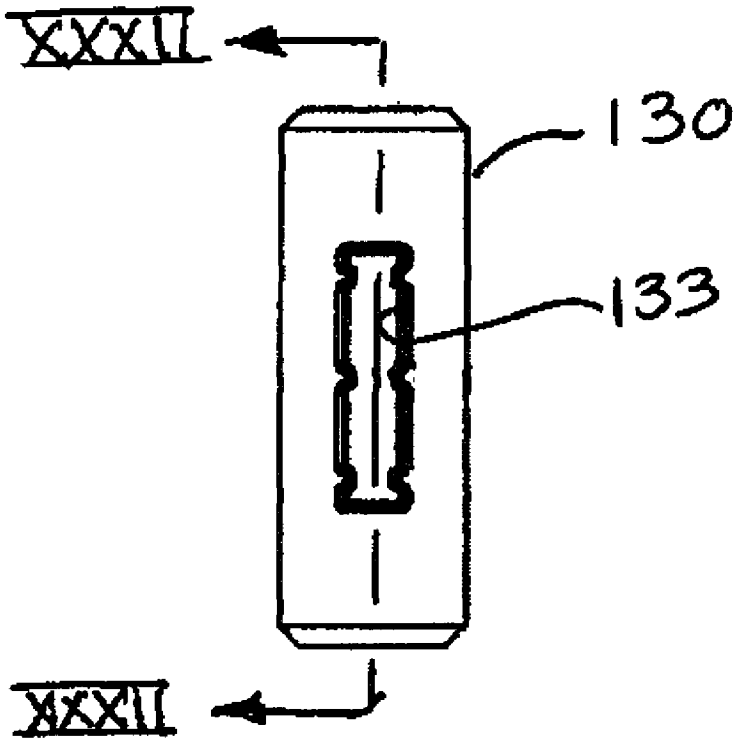
FIG. 31 is a side view of a trigger pivot useful in the practice of the present invention.
Figure 33:
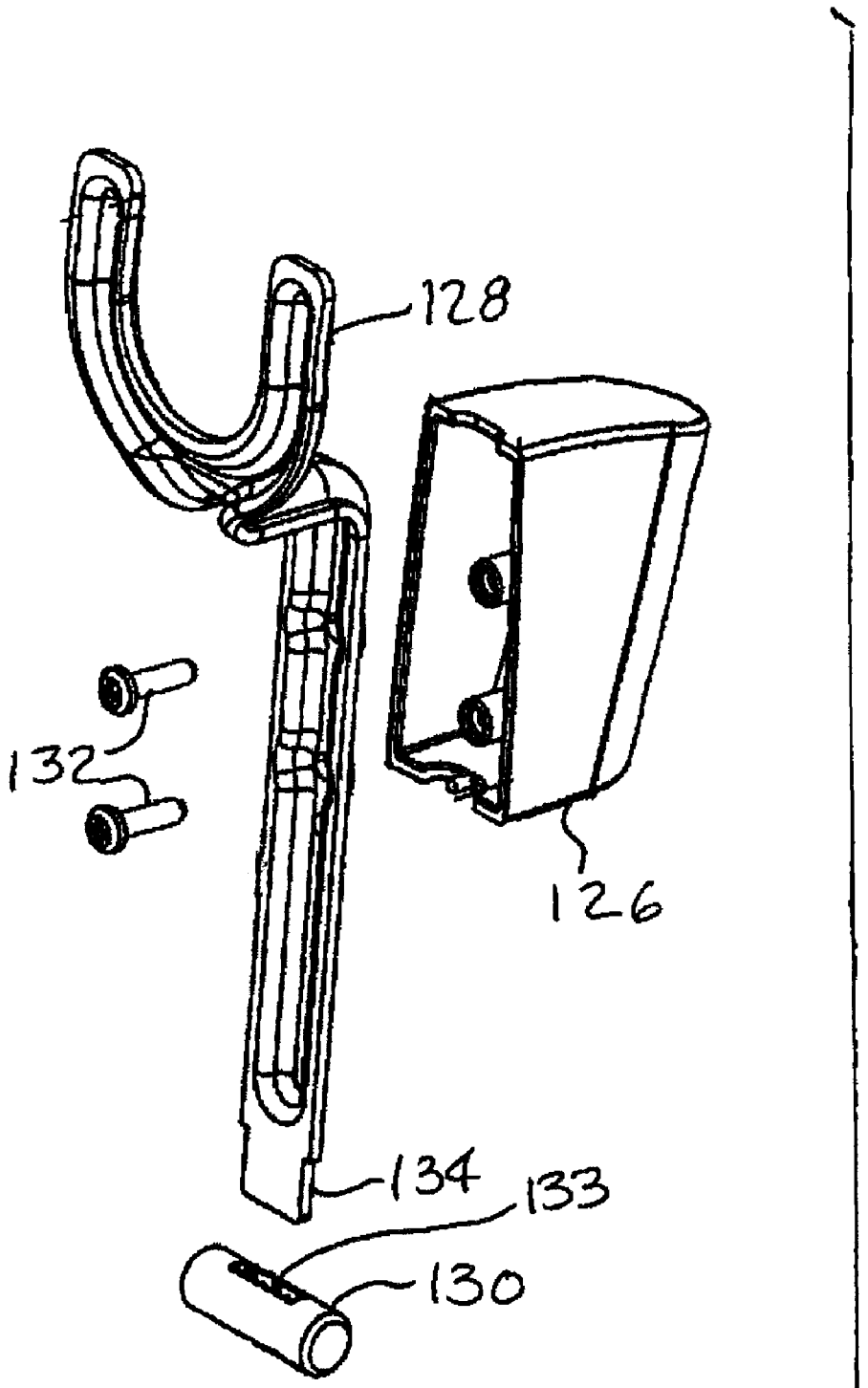
FIG. 33 is an exploded view of a trigger assembly useful in the practice of the present invention.
Figure 35:
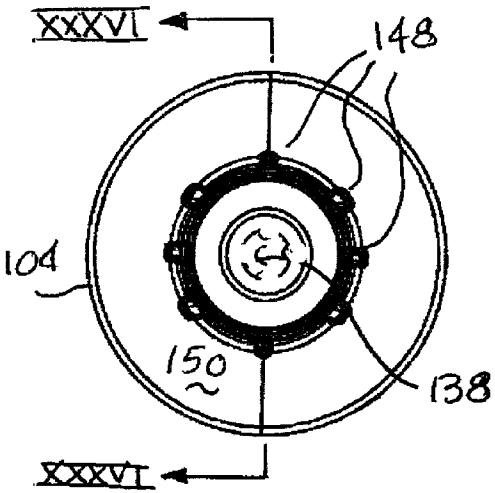
FIG. 35 is an end view of the plunger of FIG. 34.
Figure 34:
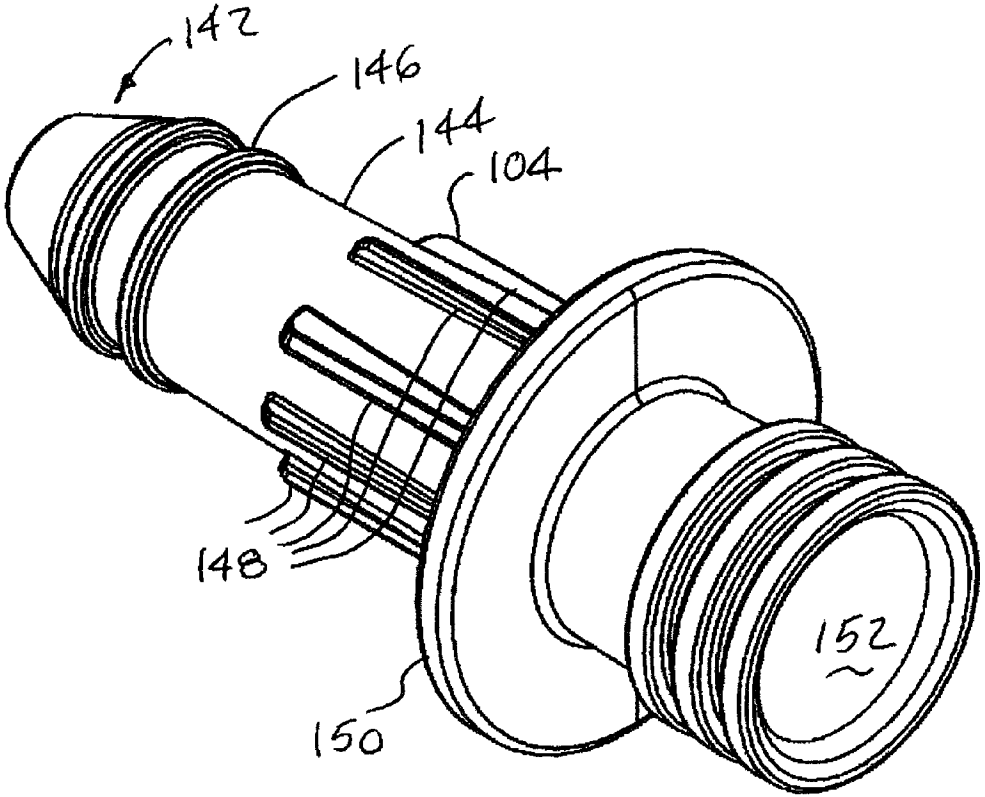
FIG. 34 is a perspective view of a plunger useful in the practice of the present invention.
Figure 37:
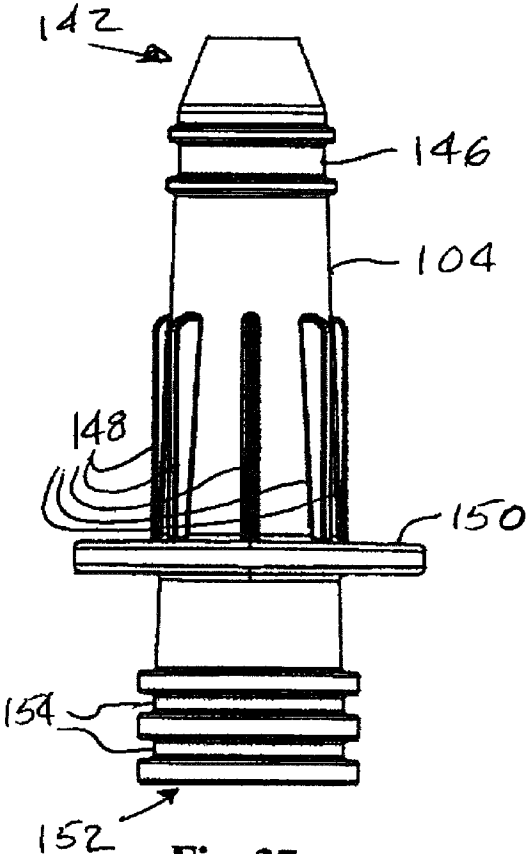
FIG. 37 is a side view of the plunger of FIG. 34.

Referring now to FIGS. 11, 12 and 13, various views of the nozzle 26 may be seen. In contrast to the prior art, the present invention has a removable nozzle threadably engaged at the front of the texture sprayer to permit convenient selection and installation of one nozzle from among a plurality of nozzles, each of which have a different sized aperture to control the spray pattern of the texture being applied by the texture sprayer. Nozzle 26 preferably has a cylindrical main body 110 having a set of internal threads 112 sized to mate with a set of external threads 114 on the nozzle plate 98 (see FIG. 14). Nozzle 26 also preferably has a conical exit orifice 116. It is to be understood that the texture sprayer 12 of the present invention may be used with alternative nozzles, particularly with a range of nozzles, each with a different characteristic diameter for the exit orifice 116, and each of which have the same size threads 112 to fit the texture sprayer of the present invention. Each nozzle 26 may be formed of polypropylene or another suitable polymer material.

FIGS. 14-18 show various views of the nozzle plate 98. Nozzle plate 98 has a forwardly directed cylindrical element 118 carrying the external threads 114 sized to receive and threadably engage the threads 112 of each nozzle 26 to be used with the texture sprayer 12. Nozzle plate 98 also has a radially extending flange 120 integrally formed with the element 118. Flange 120 is preferably captured between right and left gun shell halves 94,96 to position the nozzle plate 98 in line with the plunger 104. The nozzle plate 98 receives and mates with a downstream end 142 of the plunger 104 when the plunger 104 is in a forward position, to shut off a material flow path for texture material from the hopper 24 to the nozzle 26. Nozzle plate 98 may be formed by molding or die casting any suitable polymeric material or metal. In one embodiment, the nozzle plate 98 is molded from nylon-6. In another embodiment, the nozzle plate 98 is formed using a precision die casting process for zinc material. One such source is Dynacast Inc., of 7810 Ballantyne Commons Parkway, Suite 200, Charlotte N.C. 28277.

Referring now to FIGS. 19-22, various views of the boot 100 may be seen. Boot 100 has a first end 120 sized to fit and seal against the plunger 104 (see FIG. 36) and a second end 122 sized to fit and seal against the assembled gun shell halves 94 and 96 (see FIG. 89). Boot 100 may be formed of natural or synthetic rubber with durometer of about 70. In between first and second ends 120-122 boot 100 preferably has a thin cylindrical wall 124. When installed between plunger 104 and the gun shell, boot 100 prevents contamination of moving parts (such as the spring 106 and trigger assembly 108) of the sprayer 12 by the texture material. Bushing 102, which may be formed of nylon, is received in the second end 122 of boot 100 to support the boot 100 and maintain the seal of the second end 122 of the boot 100 against the gun shell. Bushing 102 preferably has a clearance fit with plunger 104.

Referring now to FIGS. 23-33, the various parts of the trigger assembly 108 may be seen. Trigger assembly 108 may include a trigger button 126, a trigger frame 128 and a trigger pivot 130 in the form of a slotted cylindrical member. Trigger assembly 108 may also include one or more conventional threaded fasteners 132 (such as self tapping screws) to retain the button 126 to the frame 128. Pivot 130 has a slot 133 to receive a tongue 134 of trigger frame 128 in an interference fit. Pivot 130 is preferably received in a pair of aligned cylindrical cavities 136 (see FIG. 69) in each of the gun shell halves 94, 96, more particularly, in the pistol grip 28. Button 126 and pivot 130 may each be formed of polypropylene and frame 128 may be formed of steel.

Figure 36:
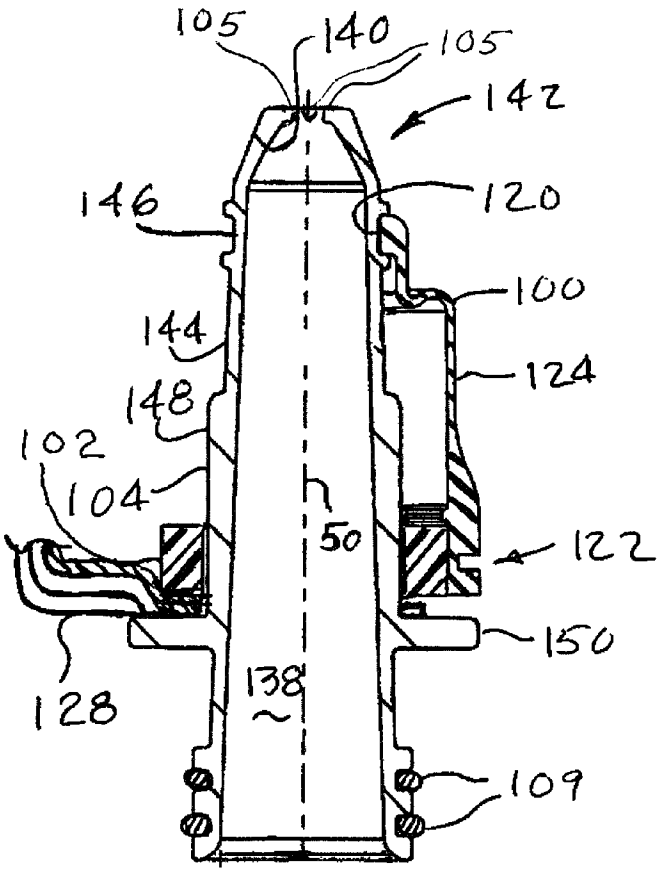
FIG. 36 is a section view along line XXXVI-XXXVI of FIG. 35, together with a half section view of the boot of FIG. 22 and a section view of a bushing and a portion of a trigger frame and a pair of O-rings mounted on the plunger to show the relationship of these parts in an assembled state.

Referring now to FIGS. 34-37, various views of the plunger 104 may be seen. In FIG. 36, the plunger 104 is shown in cross section, together with a half section view of the boot 100 and a section view of the bushing 102 and a portion of the trigger frame 128 and the pair of O-rings 109 mounted on the plunger 104. Plunger 104 has a hollow through bore 138 with a conical tapered outlet 140 at a downstream end 142. Bore 138 provides a passageway for air from the air source 20 through the plunger to the nozzle 26. Plunger 104 also has a tapered cylindrical sidewall 144 with a circumferential groove 146 and axially oriented ribs 148. Plunger 104 also has a radially extending flange 150 and an upstream end 152 having a pair of grooves 154 to receive O-rings 109. Plunger 104 may be formed of nylon 6/6 or other suitable polymer material.

Figure 38:
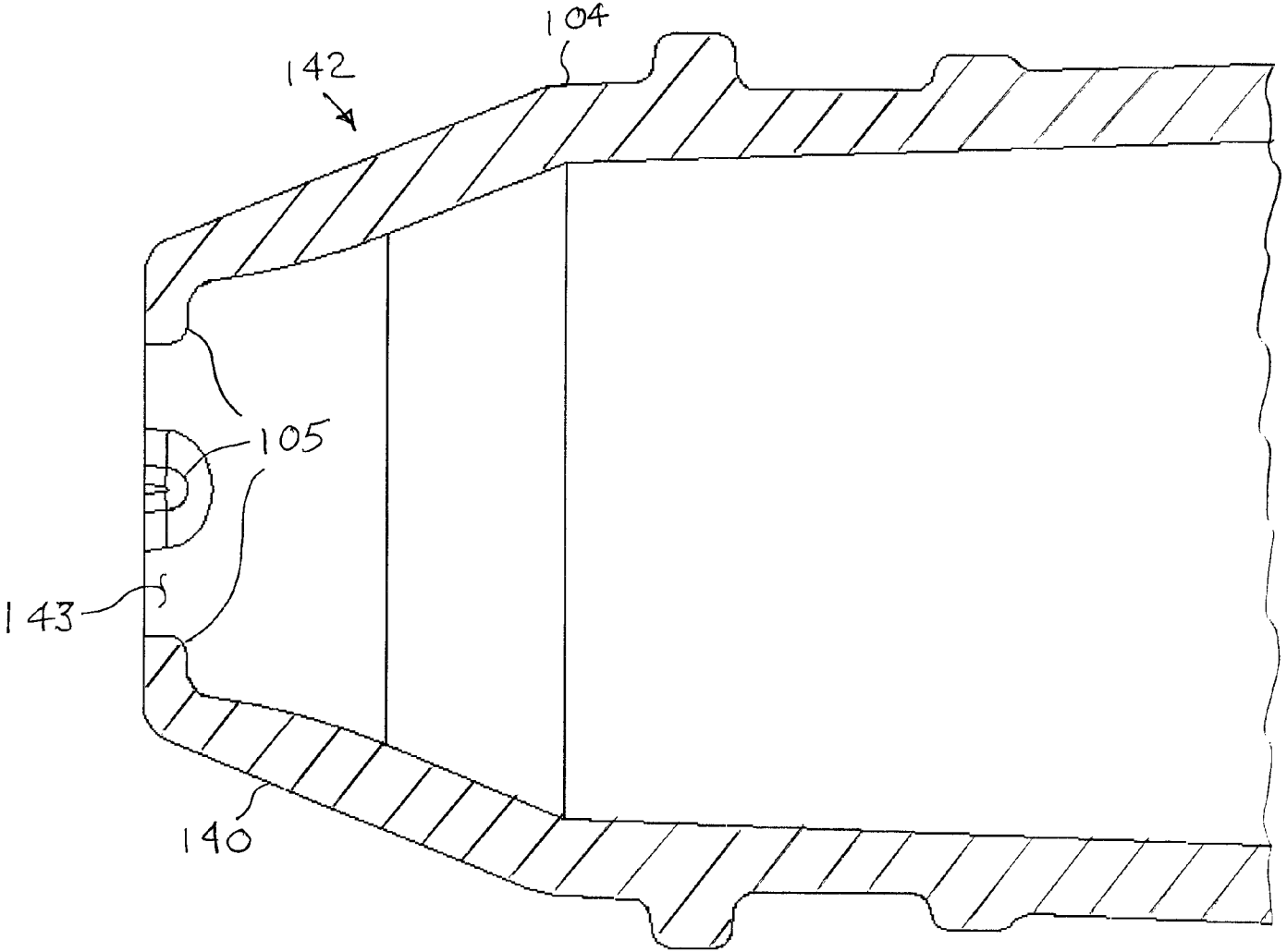
FIG. 38 is an enlarged fragmentary side section view of a front portion of the plunger showing details of a first embodiment of the present invention.
Figure 39:
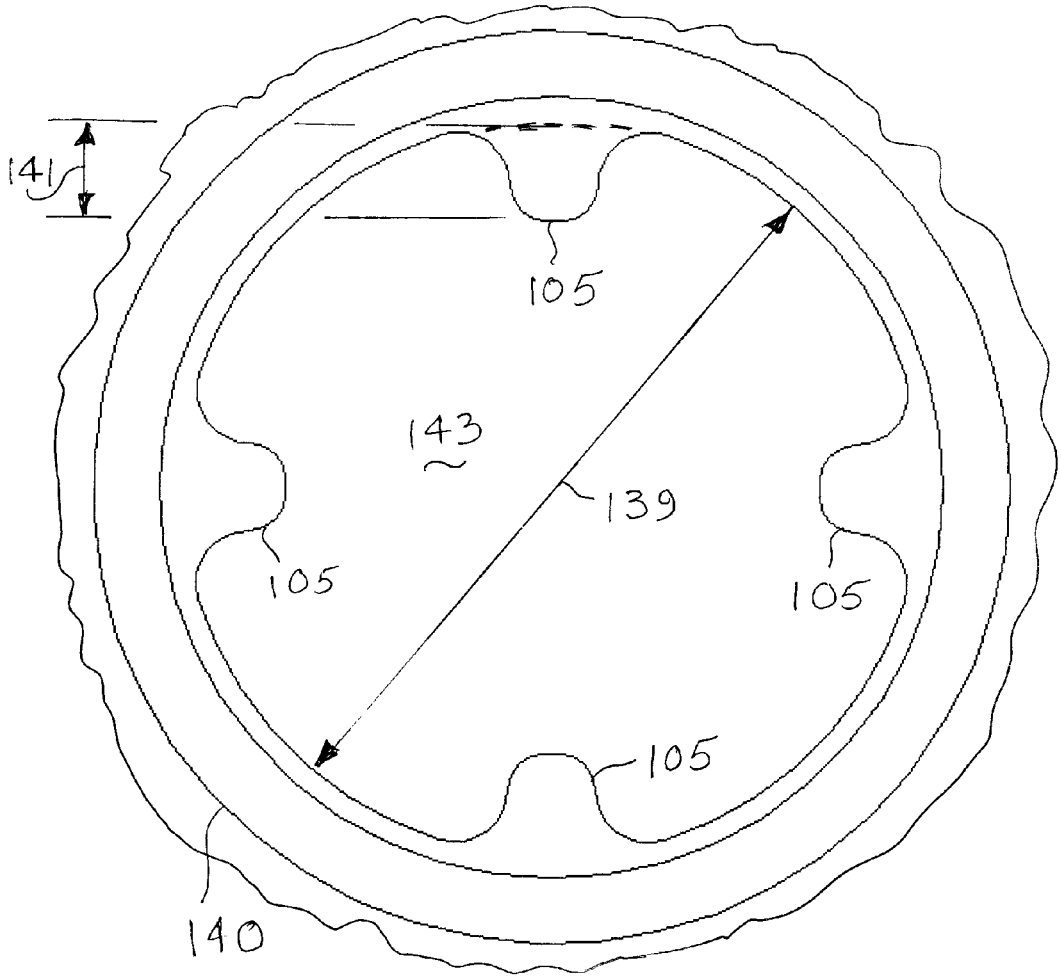
FIG. 39 is an enlarged fragmentary front view of an exit in the front portion of the plunger of FIG. 38 showing further details of the first embodiment of the present invention.
Figure 42:
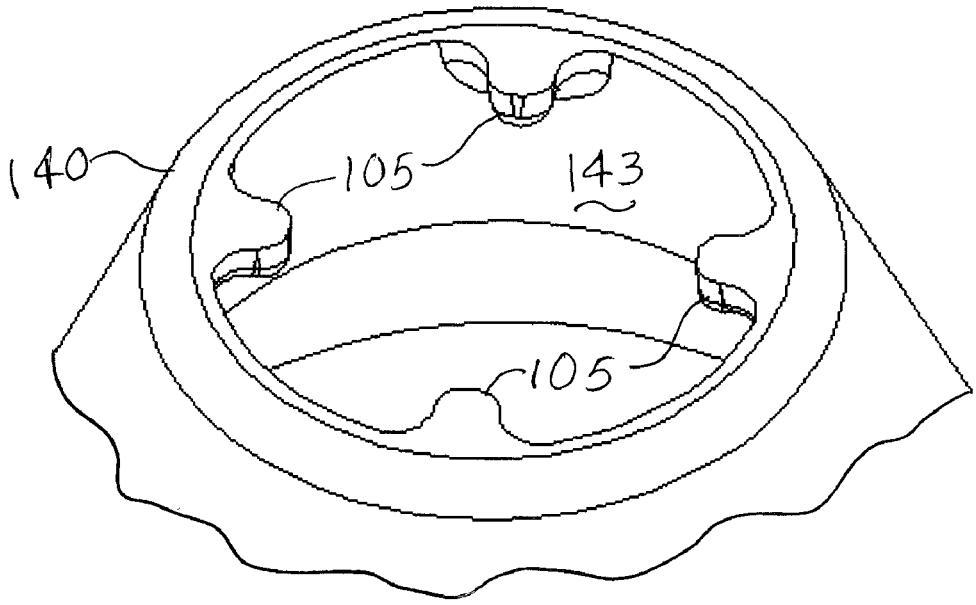
FIG. 42 is an enlarged fragmentary perspective view of an exit portion of the plunger of FIG. 38 showing further details of the first embodiment of the present invention.

Referring now to FIGS. 38, 39, and 42, in a first embodiment plunger 104 has a plurality of inwardly projecting prongs 105. As shown, there are four prongs 105, equidistantly spaced about the periphery of the outlet. It is to be understood, however, that other numbers of prongs and other circumferential spacing between prongs may be used in the practice of the present invention. It is believed that the prongs 105 interfere with acoustic resonance that otherwise may occur as air is delivered through the hollow through bore 138 of the plunger 104. Each prong 105 may project inwardly a distance 141 of 0.0585 inches from an internal diameter 139 of 0.417 inches at the exit aperture 143 of the conical tapered outlet 140 of the bore 138.

In the practice of the present invention using the first embodiment, it is to be understood that the prongs are sufficiently large to reduce noise, while at the same time, small enough to not substantially impair air flow through the bore. For example, if the air flow without the prongs is 23.75 SCFM, an air flow in the range of about 23.25 to about 22.00 SCFM would be acceptable with the prongs.

Figure 40:
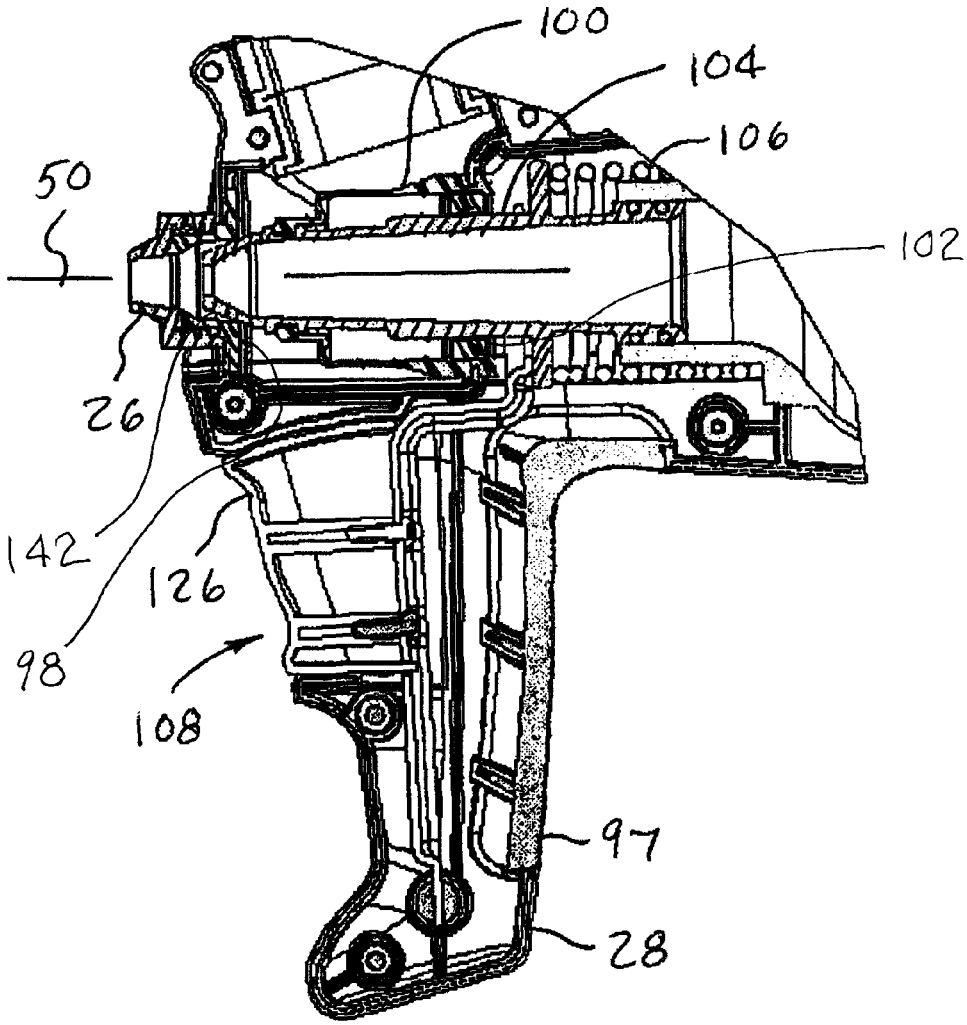
FIG. 40 is a fragmentary section view of the texture apparatus useful in the practice of the present invention shown in a first position with the trigger released and illustrating a non-spraying condition.
Figure 41:
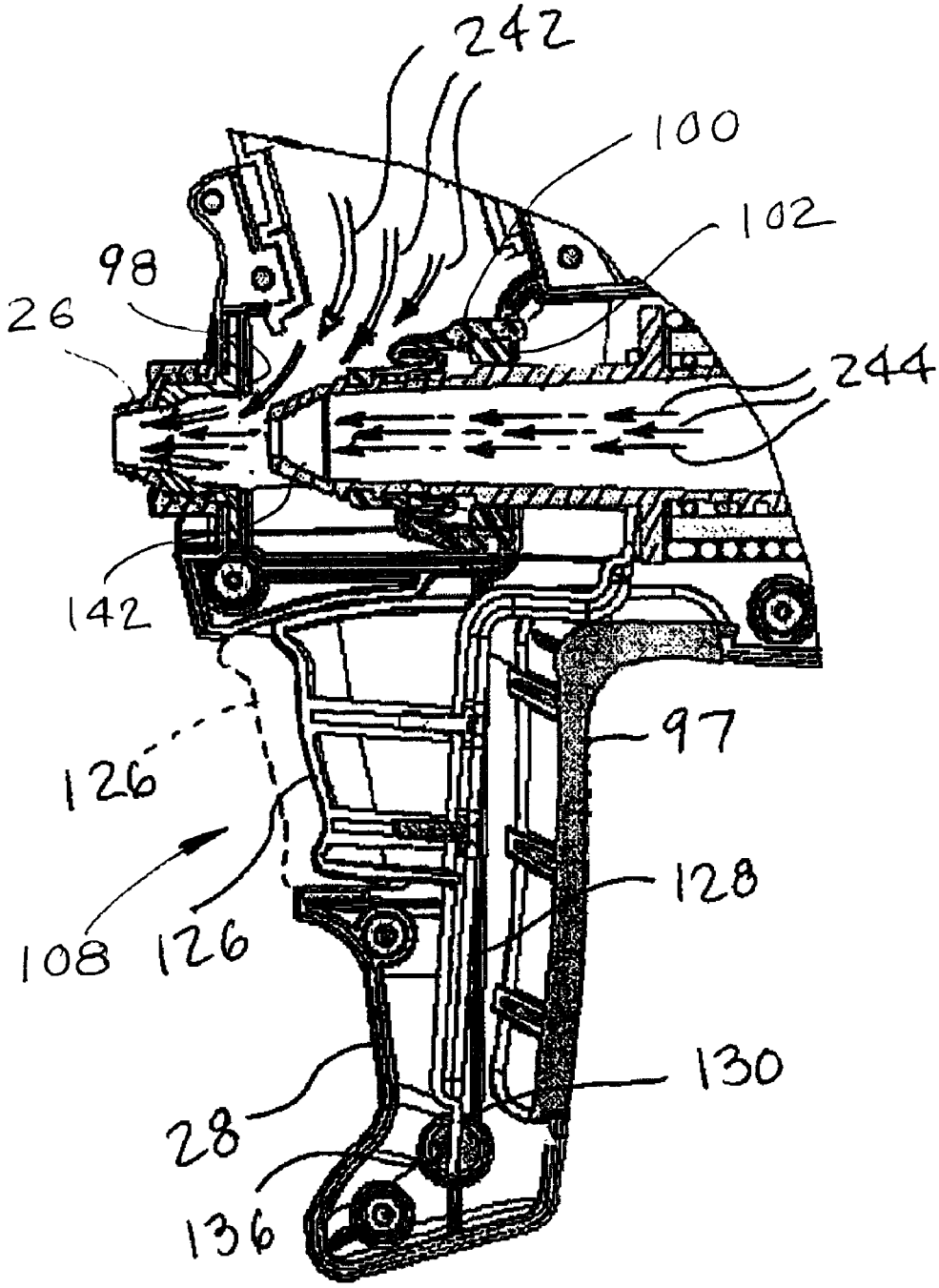
FIG. 41 is a fragmentary section view similar to that of FIG. 40, except showing a second position for parts with the trigger actuated and illustrating a texture spraying condition.

Referring now to FIGS. 40 and 41, the internal operation of the texture sprayer is illustrated. Initially the hopper 24 and air source 20 are to be connected to the body 22 of the texture sprayer, and the hopper is filled with conventional texture material, which is a combined liquid and solid mixture or slurry. In FIG. 40, the trigger button 126 is released, and the texture material is prevented from being sprayed because the downstream end 142 of the plunger 104 is in contact with the nozzle plate 98, and the path from the hopper 24 to the nozzle 26 is closed. In this condition, the air source may be turned ON to direct air through the hollow through bore 138 of the plunger 104 to ready the sprayer 12 for spraying operation. Next, the trigger button 126 is depressed, moving from the dashed line position to the solid line position shown in FIG. 41. The trigger assembly 108 moves the plunger 104 to the position shown in FIG. 41, and the texture material (indicated by arrows 242) is permitted to flow in front of the downstream end 142 of the plunger where air (indicated by arrows 244) directs the texture material through the nozzle 26 and propels it to a surface to be coated with the texture material. As may be seen by comparison of FIGS. 40 and 41, the boot 100 covers and seals the exterior of plunger 104 (and the sliding connection including bushing 102 on the exterior of plunger 104) in both an ON and OFF (spraying and non-spraying) conditions of sprayer 12; and boot 100 may be seen to telescope back on itself in the ON or operating position shown in FIG. 41.

The plunger 104 may be in the form of a frustro-conical sleeve and axis 50 may be both a nozzle cone axis and the spray path axis 50. The plunger or sleeve is movable along the nozzle cone axis to open and close the texture material passageway. The frustro-conical sleeve may have the elastomeric boot 100 surrounding the sleeve or plunger 104 adjacent at least a portion of the texture material passageway.

Referring now most particularly to FIGS. 42-48, various details of some alternative embodiments of the present invention may be seen.

Figure 43:
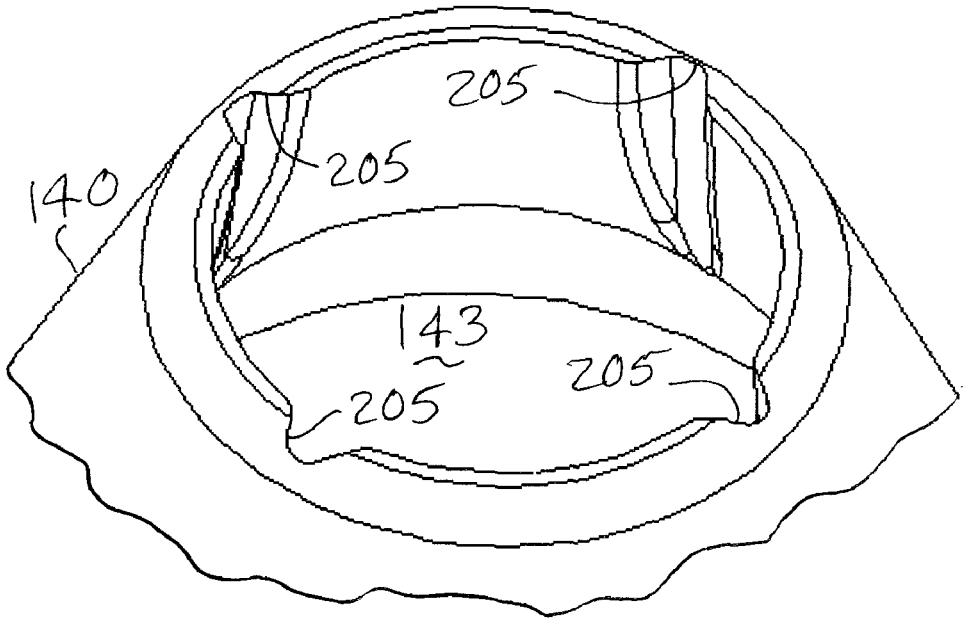
FIG. 43 is an enlarged fragmentary perspective view similar to that of FIG. 42 except showing further details of a second embodiment of the present invention.
Figure 45:
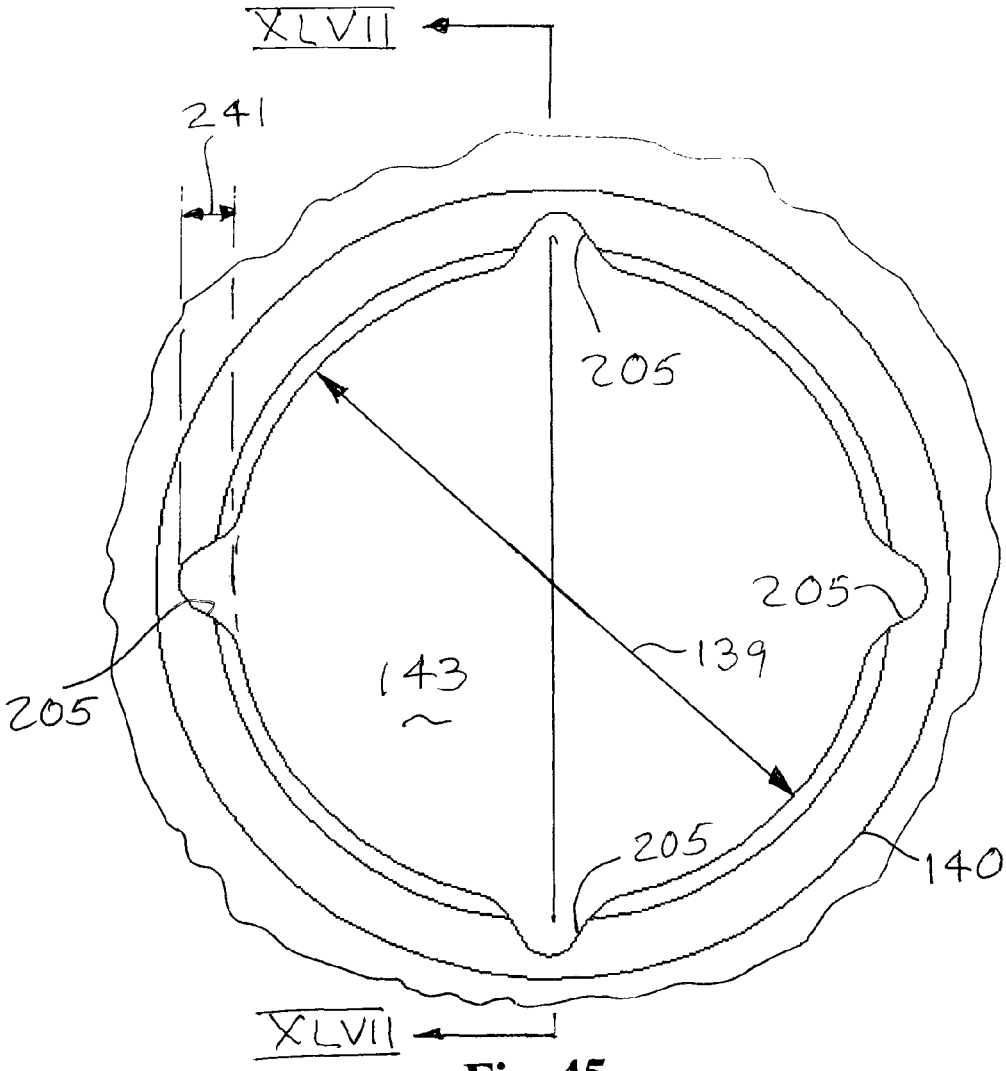
FIG. 45 is an enlarged fragmentary front view similar to that of FIG. 39 except showing details of the second embodiment of the present invention.
Figure 47:
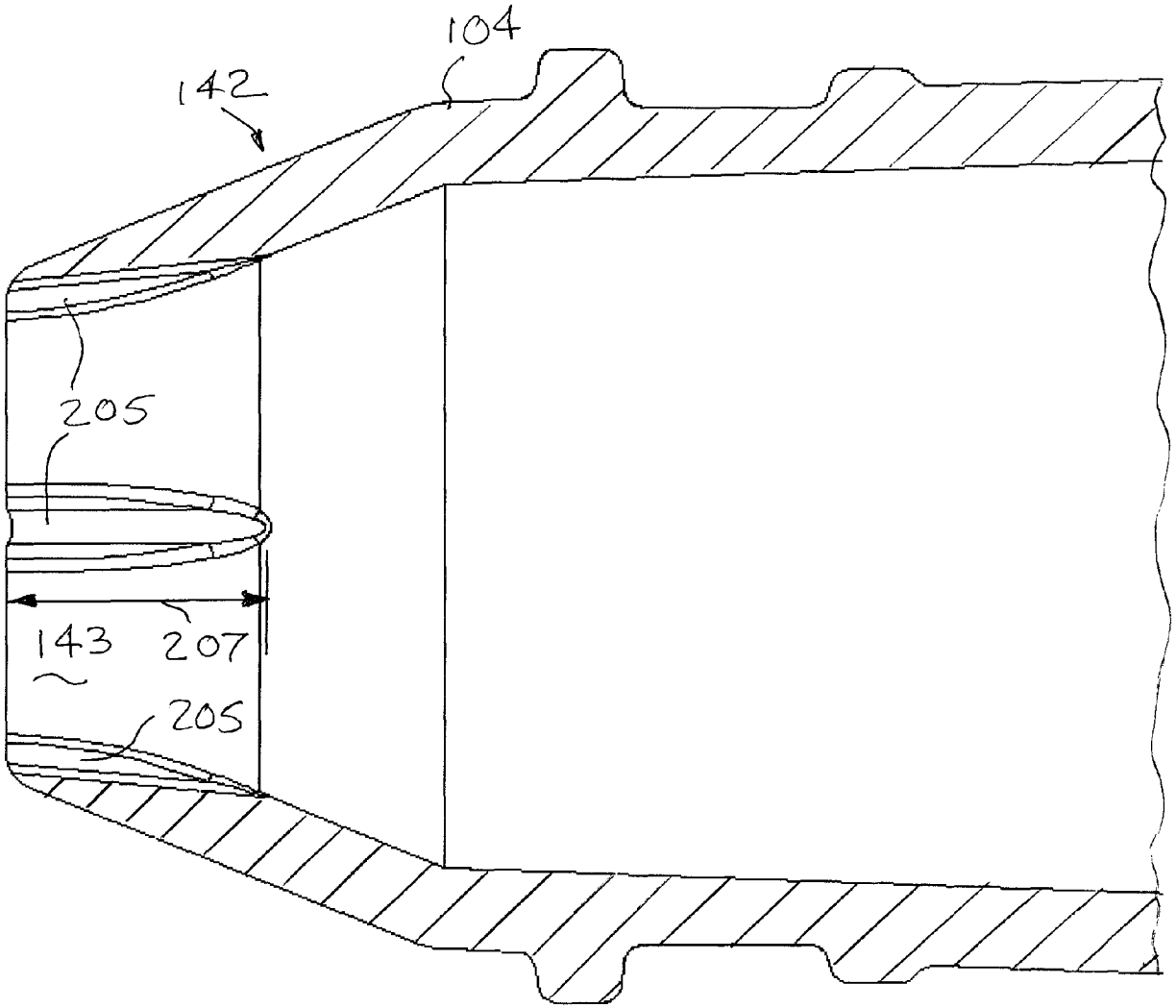
FIG. 47 is an enlarged fragmentary side section view similar to that of FIG. 38 except taken along line XLVII-XLVII of FIG. 45 showing details of the second embodiment of the present invention.

In FIGS. 43, 45 and 47, a second embodiment of the present invention is shown in which the prongs 105 are replaced by recesses 205. Recesses 205 extend radially outward from the exit aperture 143. Recesses 205, as shown particularly in FIG. 47, may extend axially upstream a distance 207 from exit aperture 143. Recesses 205 may have a radial length 241 of 0.039 inches with an internal diameter 139 the same as for the first embodiment.

Figure 44:
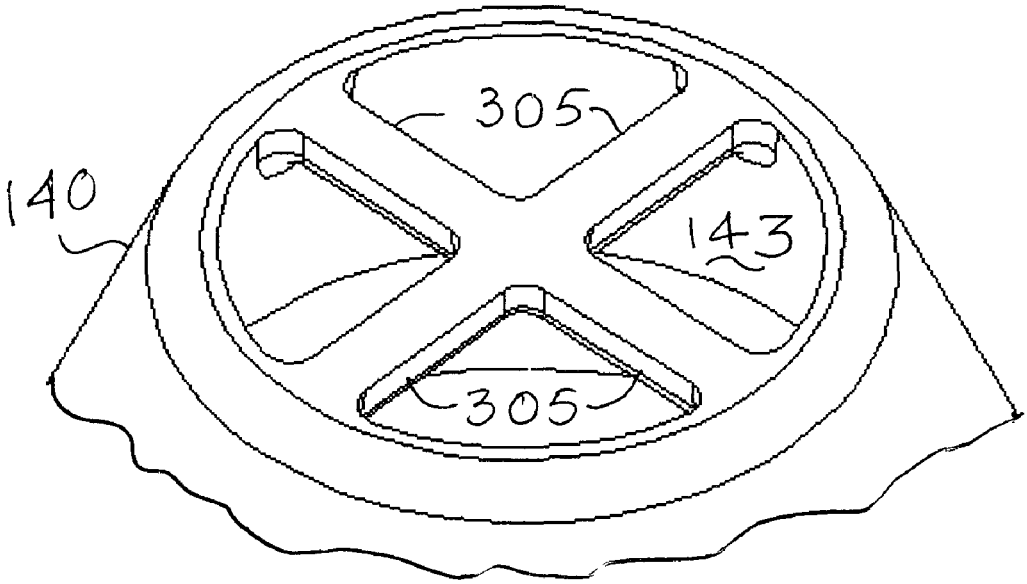
FIG. 44 is an enlarged fragmentary perspective view similar to that of FIG. 42 except showing further details of a third embodiment of the present invention.
Figure 46:
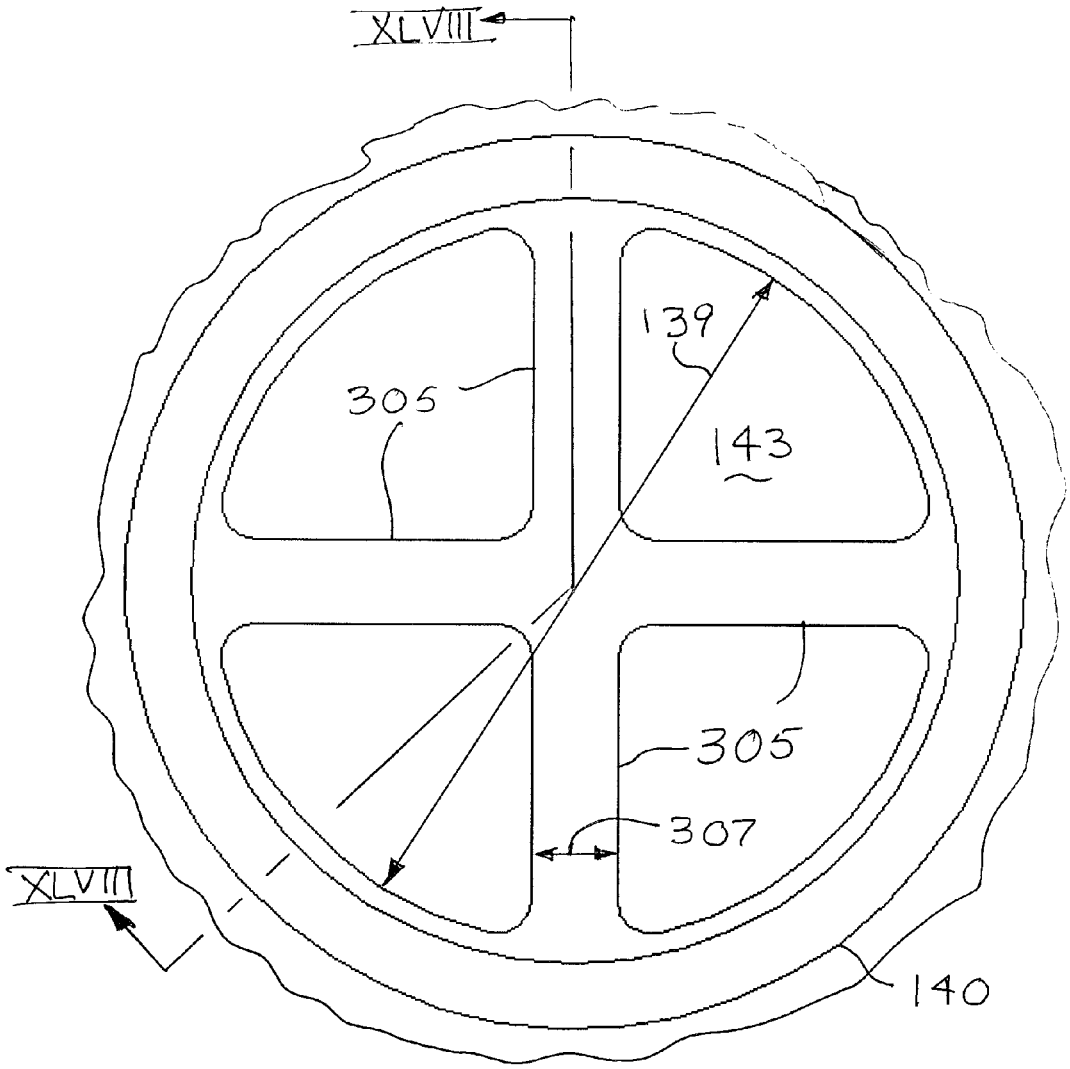
FIG. 46 is an enlarged fragmentary front view similar to that of FIG. 39 except showing details of the third embodiment of the present invention.
Figure 48:
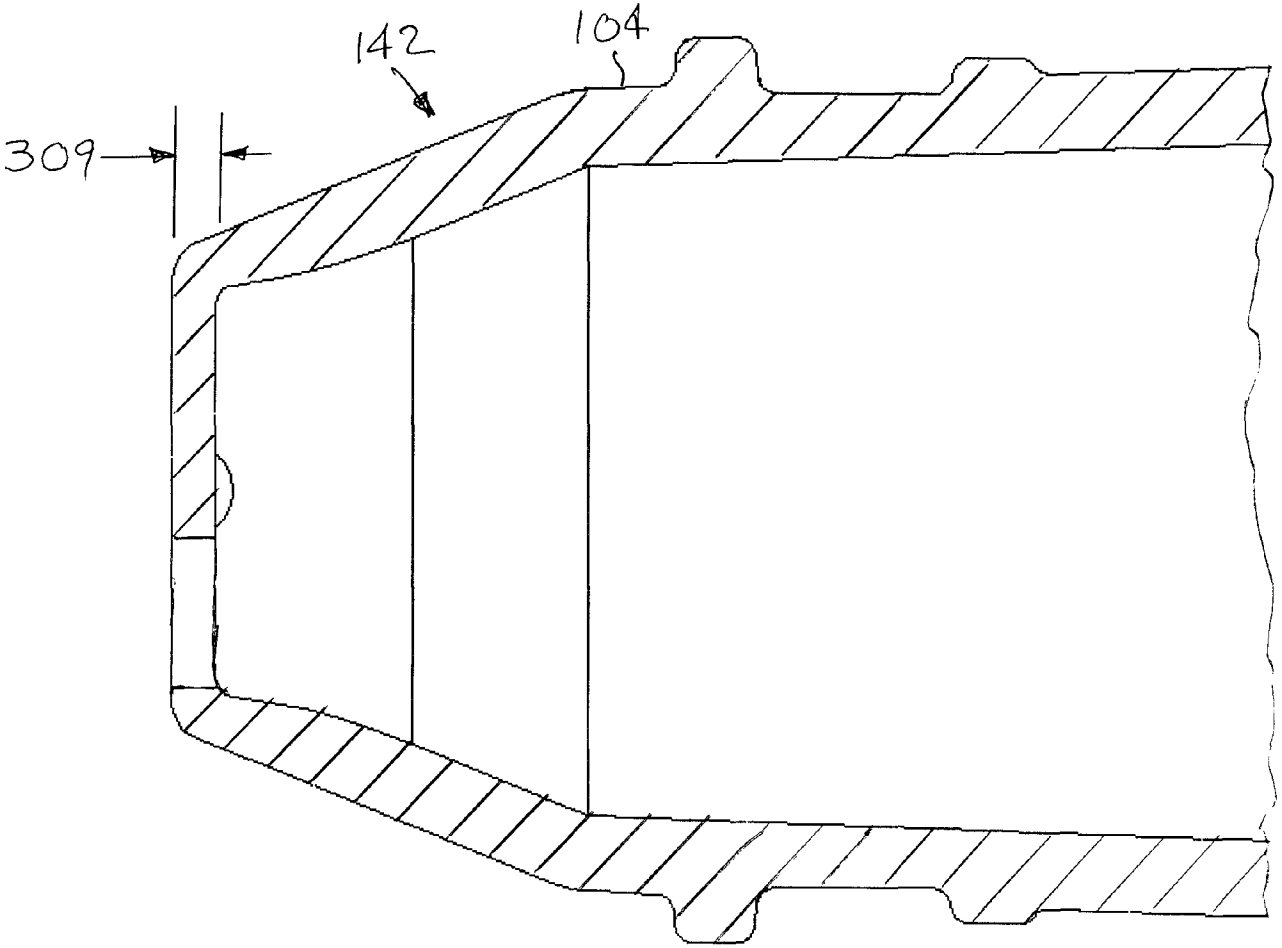
FIG. 48 is an enlarged fragmentary side section view similar to that of FIG. 38 except taken along line XLVIII-XLVIII of FIG. 46 to showing details of the third embodiment of the present invention.

In FIGS. 44, 46 and 48, a third embodiment of the present invention is shown in which the prongs 105 are replaced by radial ribs 305 extending from the periphery to the center of the outlet 140, and joining in the center to effectively extend fully across the internal diameter 139 of the exit aperture 143 of the plunger 104 at the outlet end 140. Each rib 305 may have a width 307 of 0.049 inches, and a thickness 309 of 0.045 inches.

It may thus be seen that the various embodiments of the present invention may be more generally described as one or more structural discontinuities present at an interior surface of the outlet 140 of the plunger 104 sufficient to diminish or disrupt audible energy emitted from the plunger 104. As mentioned supra, the audible energy is believed to be a result of standing waves generated by air flow through the passageway formed by bore 138 interior of plunger 104 in the absence of the structural discontinuities in the passageway of plunger 104.

This invention is not to be taken as limited to all of the details thereof as modifications and variations thereof may be made without departing from the spirit or scope of the invention. For example, and not by way of limitation, the noise reducing elements may be structures other than prongs, provided that the structures project into the bore and reduce the acoustic noise associated with the air flowing through the bore.

The invention claimed is:

1. A texture sprayer comprising:

a body;

a texture delivery nozzle on an end of the body;

a texture hopper extending above the body for holding and feeding texture material to the texture delivery nozzle;

an on-board pressurized air source comprising a turbine releasably mounted on the body;

a plunger disposed within the body, the plunger including a hollow through bore providing pressurized air from the on-board pressurized air source to the texture delivery nozzle to propel the texture material through the texture delivery nozzle; and a plurality of prongs projecting radially into the hollow through bore sufficient to reduce acoustic noise by disrupting standing waves created by air flow passing through the hollow through bore.

2. The texture sprayer of claim 1 wherein the plurality of prongs are axially positioned at an outlet of the bore.

3. The texture sprayer of claim 2 wherein the plurality of prongs comprises at least four prongs.

4. The texture sprayer of claim 1 wherein the bore has a diameter at an exit of the bore and at least one of the plurality of prongs projects a radial distance into the bore of about one eighth to about one fourth of the diameter of the bore.

5. The texture sprayer of claim 4 wherein the bore has an exit with a diameter of about 0.417 inches and each of the plurality of prongs have a radial height of about 0.0521 inches.

6. The texture sprayer of claim 1 wherein the plurality of prongs are generally equidistantly spaced about a circumference of the bore.

7. The texture sprayer of claim 1, further comprising a pistol grip extending below the body.

8. The texture spray of claim 7, further comprising an arm rest extending below the body at a location spaced from the pistol grip, the arm rest supporting the texture sprayer on a user's arm when the pistol grip is grasped by the user, the pistol grip and arm rest in combination forming a support that supports the texture sprayer with the texture material hopper upright when the apparatus is placed on a horizontal surface.

9. The texture sprayer of claim 8, wherein the on-board pressurized air source is releasably mounted on the body above the arm rest.

10. The texture sprayer of claim 1, further comprising a material connection structure for movably connecting the texture hopper to the apparatus to enable the texture hopper to be moved with respect to the texture sprayer and enable the texture hopper to feed texture material as the texture sprayer is moved from a horizontal spray position to an upwardly, above horizontal, spray position.

11. The texture sprayer of claim 10, wherein the hopper further comprises a generally cone-shaped structure with a top opening and having a conic axis and the material connection structure further comprises a rotatable connector having an axis of rotation to allow positioning of the conic axis of the cone-shaped structure at a location in a cone-shaped path such that the hopper may be rotated to:

i. a first position wherein the conic axis is directed generally vertically with the texture delivery nozzle directed in a horizontal direction, and ii. a second position wherein the conic axis is directed generally vertically when texture delivery nozzle is directed upward above the horizontal direction.

12. The texture sprayer of claim 8, wherein the arm rest comprises a pair of legs.

13. The texture sprayer of claim 12 wherein the pistol grip and pair of legs provide a three point support for the texture sprayer when placed on a horizontal surface.

* * * * *